US011781324B2

(12) United States Patent
Ylikangas et al.

(10) Patent No.: US 11,781,324 B2
(45) **Date of Patent: *Oct. 10, 2023**

(54) UNLOCKING SYSTEM FOR PANELS

(71) Applicant: Välinge Innovation AB, Viken (SE)

(72) Inventors: Roger Ylikangas, Lerberget (SE); Karl Quist, Höganäs (SE); Anders Nilsson, Helsingborg (SE); Caroline Landgård, Höganäs (SE)

(73) Assignee: Välinge Innovation AB, Viken (SE)

( * ) Notice: Subject to any disclaimer, the term of this patent is extended or adjusted under 35 U.S.C. 154(b) by 69 days.

This patent is subject to a terminal disclaimer.

(21) Appl. No.: 17/342,624

(22) Filed: Jun. 9, 2021

(65) Prior Publication Data

US 2021/0381255 A1 Dec. 9, 2021

Related U.S. Application Data

(63) Continuation of application No. 16/713,373, filed on Dec. 13, 2019, now Pat. No. 11,060,302.

(30) Foreign Application Priority Data

Jan. 10, 2019 (SE) ..... 1950024-8

(51) Int. Cl.
*E04F 15/00* (2006.01)
*E04F 15/02* (2006.01)
(Continued)

(52) U.S. Cl.
CPC ..... *E04F 15/02038* (2013.01); *E04C 2/40* (2013.01); *E04F 15/04* (2013.01);
(Continued)

(58) Field of Classification Search
CPC ..... E04F 15/02033; E04F 15/02038; E04F 15/107; E04F 15/102; E04F 2201/042;
(Continued)

(56) References Cited

U.S. PATENT DOCUMENTS 87,853 A 3/1869 Kappes
108,068 A 10/1870 Utley
(Continued)

FOREIGN PATENT DOCUMENTS

CN 201588375 U 9/2010
CN 201110035241.6 1/2011
(Continued)

OTHER PUBLICATIONS

Swedish Office Action with Swedish Search Report in SE 1950024-8, including ITS-Search Report in ITS/SE19/00001, dated Sep. 3, 2019, Swedish Patent and Registration Office, 23 pages.
(Continued)

*Primary Examiner* — Chi Q Nguyen
(74) *Attorney, Agent, or Firm* — Boone IP Law

(57) ABSTRACT

A set of essentially identical panels, such as building panels, provided with a mechanical locking system including a displaceable tongue arranged in a displacement groove having a first opening at a first edge of a first panel. The tongue is configured to be displaced in the displacement groove along a displacement axis to attain a locking state wherein a first portion of the tongue cooperates with a first tongue groove having a second opening at a second edge of an adjacent second panel, for vertical locking of the first and the second edge. A second portion of the tongue is configured to cooperate with the second edge of the adjacent second panel via an elongated element for vertical unlocking of the first and the second edge.

17 Claims, 10 Drawing Sheets

(51) Int. Cl.
*E04F 15/04* (2006.01)
*E04C 2/40* (2006.01)

(52) U.S. Cl.
CPC ... *E04F 2201/023* (2013.01); *E04F 2201/044* (2013.01); *E04F 2201/0523* (2013.01)

(58) Field of Classification Search
CPC ..... E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138; E04F 15/04; E04F 2201/044; E05F 2201/0523; E04C 2/40
USPC .. 52/592.1, 592.3, 592.2, 578, 588.1, 309.1, 52/309.3
See application file for complete search history.

(56) References Cited

U.S. PATENT DOCUMENTS 124,228 A 3/1872 Stuart
213,740 A 4/1879 Conner
274,354 A 3/1883 McCarthy et al.
316,176 A 4/1885 Ransom
634,581 A 10/1899 Miller
861,911 A 7/1907 Stewart
1,194,636 A 8/1916 Joy
1,723,306 A 8/1929 Sipe
1,743,492 A 1/1930 Sipe
1,809,393 A 6/1931 Rockwell
1,902,716 A 3/1933 Newton
2,026,511 A 12/1935 Storm
2,027,292 A 1/1936 Rockwell
2,110,728 A 3/1938 Hoggatt
2,142,305 A 1/1939 Davis
2,204,675 A 6/1940 Grunert
2,266,464 A 12/1941 Kraft
2,277,758 A 3/1942 Hawkins
2,430,200 A 11/1947 Wilson
2,596,280 A 5/1952 Nystrom
2,732,706 A 1/1956 Friedman
2,740,167 A 4/1956 Rowley
2,858,584 A 11/1958 Gaines
2,863,185 A 12/1958 Riedi
2,865,058 A 12/1958 Andersson
2,889,016 A 6/1959 Warren
3,023,681 A 3/1962 Worson
3,077,703 A 2/1963 Bergstrom
3,099,110 A 7/1963 Spaight
3,147,522 A 9/1964 Schumm
3,172,237 A 3/1965 Bradley
3,187,612 A 6/1965 Hervey
3,271,787 A 9/1966 Clary
3,276,797 A 10/1966 Humes, Jr.
3,308,588 A 3/1967 Von Wedel
3,325,585 A 6/1967 Brenneman
3,331,180 A 7/1967 Vissing et al.
3,378,958 A 4/1968 Parks et al.
3,396,640 A 8/1968 Fujihara
3,512,324 A 5/1970 Reed
3,517,927 A 6/1970 Kennel
3,526,071 A 9/1970 Watanabe
3,535,844 A 10/1970 Glaros
3,572,224 A 3/1971 Perry
3,579,941 A 5/1971 Tibbals
3,626,822 A 12/1971 Koster
3,640,191 A 2/1972 Hendrich
3,694,983 A 10/1972 Couquet
3,720,027 A 3/1973 Christensen
3,722,379 A 3/1973 Koester
3,731,445 A 5/1973 Hoffmann et al.
3,742,669 A 7/1973 Mansfeld
3,760,547 A 9/1973 Brenneman
3,760,548 A 9/1973 Sauer et al.
3,764,767 A 10/1973 Randolph
3,778,954 A 12/1973 Meserole
3,849,235 A 11/1974 Gwynne
3,919,820 A 11/1975 Green
3,950,915 A 4/1976 Cole
3,994,609 A 11/1976 Puccio
4,007,767 A 2/1977 Colledge
4,007,994 A 2/1977 Brown
4,030,852 A 6/1977 Hein
4,037,377 A 7/1977 Howell et al.
4,041,665 A 8/1977 de Munck
4,064,571 A 12/1977 Phipps
4,080,086 A 3/1978 Watson
4,082,129 A 4/1978 Morelock
4,100,710 A 7/1978 Kowallik
4,104,840 A 8/1978 Heintz et al.
4,107,892 A 8/1978 Bellem
4,113,399 A 9/1978 Hansen, Sr. et al.
4,154,041 A 5/1979 Namy
4,169,688 A 10/1979 Toshio
RE30,154 E 11/1979 Jarvis
4,196,554 A 4/1980 Anderson
4,227,430 A 10/1980 Janssen et al.
4,299,070 A 11/1981 Oltmanns
4,304,083 A 12/1981 Anderson
4,426,820 A * 1/1984 Terbrack ..... E04F 15/10 52/590.1
4,447,172 A 5/1984 Galbreath
4,512,131 A 4/1985 Laramore
4,599,841 A 7/1986 Haid
4,622,784 A 11/1986 Black
4,648,165 A 3/1987 Whitehorne
4,819,932 A 4/1989 Trotter, Jr.
4,948,716 A 8/1990 Mihayashi et al.
4,998,395 A 3/1991 Bezner
5,007,222 A 4/1991 Raymond
5,026,112 A 6/1991 Rice
5,071,282 A 12/1991 Brown
5,135,597 A 8/1992 Barker
5,148,850 A 9/1992 Urbanick
5,173,012 A 12/1992 Ortwein et al.
5,182,892 A 2/1993 Chase
5,247,773 A 9/1993 Weir
5,272,850 A 12/1993 Mysliwiec et al.
5,274,979 A 1/1994 Tsai
5,281,055 A 1/1994 Neitzke et al.
5,293,728 A 3/1994 Christopher et al.
5,295,341 A 3/1994 Kajiwara
5,344,700 A 9/1994 McGath et al.
5,348,778 A 9/1994 Knipp et al.
5,373,674 A 12/1994 Winter, IV
5,465,546 A 11/1995 Buse
5,485,702 A 1/1996 Sholton
5,502,939 A 4/1996 Zadok et al.
5,548,937 A 8/1996 Shimonohara
5,577,357 A 11/1996 Civelli
5,587,218 A 12/1996 Betz
5,598,682 A 2/1997 Haughian
5,616,389 A 4/1997 Blatz
5,618,602 A 4/1997 Nelson
5,634,309 A 6/1997 Polen
5,658,086 A 8/1997 Brokaw et al.
5,694,730 A 12/1997 Del Rincon et al.
5,755,068 A 5/1998 Ormiston
5,860,267 A 1/1999 Pervan
5,899,038 A 5/1999 Stroppiana
5,910,084 A 6/1999 Koike
5,950,389 A 9/1999 Porter
5,970,675 A 10/1999 Schray
6,006,486 A 12/1999 Moriau
6,029,416 A 2/2000 Andersson
6,052,960 A 4/2000 Yonemura
6,065,262 A 5/2000 Motta
6,098,354 A 8/2000 Skandis
6,122,879 A 9/2000 Montes
6,134,854 A 10/2000 Stanchfield
6,145,261 A 11/2000 Godfrey et al.
6,164,618 A 12/2000 Yonemura

(56) References Cited

U.S. PATENT DOCUMENTS 6,173,548 B1 1/2001 Hamar et al.
6,182,410 B1 2/2001 Pervan
6,203,653 B1 3/2001 Seidner
6,210,512 B1 4/2001 Jones
6,254,301 B1 7/2001 Hatch
6,295,779 B1 10/2001 Canfield
6,314,701 B1 11/2001 Meyerson
6,324,796 B1 12/2001 Heath
6,324,809 B1 12/2001 Nelson
6,332,733 B1 12/2001 Hamberger
6,339,908 B1 1/2002 Chuang
6,345,481 B1 2/2002 Nelson
6,358,352 B1 3/2002 Schmidt
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,450,235 B1 9/2002 Lee
6,490,836 B1 12/2002 Moriau et al.
6,505,452 B1 1/2003 Hannig
6,546,691 B2 4/2003 Leopolder
6,553,724 B1 4/2003 Bigler
6,576,079 B1 6/2003 Kai
6,584,747 B2 7/2003 Kettler et al.
6,588,166 B2 7/2003 Martensson
6,591,568 B1 7/2003 Pålsson
6,601,359 B2 8/2003 Olofsson
6,617,009 B1 9/2003 Chen et al.
6,647,689 B2 11/2003 Pletzer et al.
6,647,690 B1 11/2003 Martensson
6,651,400 B1 11/2003 Murphy
6,670,019 B2 12/2003 Andersson
6,672,030 B2 1/2004 Schulte
6,681,820 B2 1/2004 Olofsson
6,682,254 B1 1/2004 Olofsson et al.
6,684,592 B2 2/2004 Martin
6,685,391 B1 2/2004 Gideon
6,729,091 B1 5/2004 Martensson
6,763,643 B1 7/2004 Martensson
6,766,622 B1 7/2004 Thiers
6,769,219 B2 8/2004 Schwitte et al.
6,769,835 B2 8/2004 Stridsman
6,802,166 B1 10/2004 Gerhard
6,804,926 B1 10/2004 Eisermann
6,808,777 B2 10/2004 Andersson et al.
6,854,235 B2 2/2005 Martensson
6,862,857 B2 3/2005 Tychsen
6,865,855 B2 * 3/2005 Knauseder ..... E04B 9/28 52/592.1
6,874,291 B1 4/2005 Weber
6,880,307 B2 4/2005 Schwitte et al.
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson
7,152,383 B1 12/2006 Wilkinson et al.
7,156,383 B1 1/2007 Jacobs
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,380,383 B2 6/2008 Olofsson et al.
7,441,384 B2 10/2008 Miller et al.
7,451,578 B2 11/2008 Hannig
7,454,875 B2 11/2008 Pervan et al.
7,516,588 B2 4/2009 Pervan
7,517,427 B2 4/2009 Sjoberg et al.
7,520,092 B2 4/2009 Showers et al.
7,533,500 B2 5/2009 Morton et al.
7,556,849 B2 7/2009 Thompson et al.
7,568,322 B2 8/2009 Pervan
7,584,583 B2 9/2009 Bergelin et al.
7,591,116 B2 9/2009 Thiers et al.
7,603,826 B1 * 10/2009 Moebus ..... E04F 15/04 52/592.4
7,614,197 B2 11/2009 Nelson
7,617,651 B2 11/2009 Grafenauer
7,621,092 B2 11/2009 Groeke et al.
7,621,094 B2 11/2009 Moriau et al.
7,634,884 B2 12/2009 Pervan
7,637,068 B2 12/2009 Pervan
7,644,553 B2 1/2010 Knauseder
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,748,176 B2 7/2010 Harding et al.
7,757,452 B2 7/2010 Pervan
7,802,411 B2 9/2010 Pervan
7,806,624 B2 10/2010 McLean et al.
7,827,749 B2 11/2010 Groeke et al.
7,841,144 B2 11/2010 Pervan et al.
7,841,145 B2 11/2010 Pervan et al.
7,841,150 B2 11/2010 Pervan
7,849,642 B2 12/2010 Forster et al.
7,856,789 B2 12/2010 Eisermann
7,861,482 B2 1/2011 Pervan et al.
7,866,110 B2 1/2011 Pervan
7,896,571 B1 3/2011 Hannig et al.
7,900,416 B1 3/2011 Yokubison et al.
7,908,815 B2 3/2011 Pervan et al.
7,908,816 B2 3/2011 Grafenauer
7,913,471 B2 3/2011 Pervan
7,930,862 B2 4/2011 Bergelin et al.
7,954,295 B2 6/2011 Pervan
7,964,133 B2 6/2011 Cappelle
7,980,039 B2 7/2011 Groeke
7,980,041 B2 7/2011 Pervan
8,001,741 B2 8/2011 Duernberger
8,006,458 B1 * 8/2011 Olofsson ..... E04F 15/02016 52/489.1
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,220,217 B2 7/2012 Muehlebach
8,234,830 B2 8/2012 Pervan et al.
8,245,478 B2 8/2012 Bergelin
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,794 B2 1/2013 Biro et al.
8,359,805 B2 1/2013 Pervan et al.
8,365,499 B2 2/2013 Nilsson et al.
8,375,673 B2 2/2013 Evjen
8,381,476 B2 2/2013 Hannig
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,522,505 B2 9/2013 Beach
8,528,289 B2 9/2013 Pervan et al.
8,544,230 B2 10/2013 Pervan
8,544,232 B2 10/2013 Wybo
8,544,233 B2 10/2013 Pålsson
8,544,234 B2 10/2013 Pervan et al.
8,572,922 B2 11/2013 Pervan
8,578,675 B2 11/2013 Palsson et al.
8,590,250 B2 11/2013 Oh

(56) References Cited

U.S. PATENT DOCUMENTS 8,596,013 B2 12/2013 Boo
8,615,952 B2 12/2013 Engström
8,621,814 B2 1/2014 Cappelle
8,627,862 B2 1/2014 Pervan et al.
8,631,623 B2 1/2014 Engström
8,635,829 B2 1/2014 Schulte
8,640,418 B2 2/2014 Paetrow et al.
8,640,424 B2 2/2014 Pervan et al.
8,650,826 B2 2/2014 Pervan et al.
8,677,714 B2 3/2014 Pervan
8,689,512 B2 4/2014 Pervan
8,701,368 B2 4/2014 Vermeulen
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,806,832 B2 8/2014 Kell
8,833,026 B2 9/2014 Devos et al.
8,844,236 B2 9/2014 Pervan et al.
8,857,126 B2 10/2014 Pervan et al.
8,869,485 B2 10/2014 Pervan
8,887,468 B2 11/2014 Hakansson et al.
8,898,988 B2 12/2014 Pervan
8,925,274 B2 1/2015 Pervan et al.
8,938,929 B2 1/2015 Engström
8,959,866 B2 2/2015 Pervan
8,973,331 B2 3/2015 Boo
8,991,055 B2 3/2015 Cappelle
8,997,423 B2 4/2015 Mann
8,997,430 B1 4/2015 Vermeulen et al.
9,027,306 B2 5/2015 Pervan
9,051,738 B2 6/2015 Pervan et al.
9,068,360 B2 6/2015 Pervan
9,080,329 B2 7/2015 Döhring
9,091,077 B2 7/2015 Boo
9,103,126 B2 8/2015 Kell
9,103,128 B2 8/2015 Pomberger
9,151,062 B2 10/2015 Cappelle et al.
9,181,697 B2 11/2015 Masanek, Jr. et al.
9,194,134 B2 11/2015 Nygren et al.
9,206,611 B2 * 12/2015 Vermeulen ..... E04B 5/023
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,290,948 B2 3/2016 Capelle
9,309,679 B2 4/2016 Pervan et al.
9,316,002 B2 4/2016 Boo
9,340,974 B2 5/2016 Pervan et al.
9,347,227 B2 5/2016 Ramachandra et al.
9,347,469 B2 5/2016 Pervan
9,359,774 B2 6/2016 Pervan
9,366,034 B2 6/2016 Meirlaen et al.
9,366,036 B2 6/2016 Pervan
9,371,654 B2 6/2016 Capelle
9,376,821 B2 6/2016 Pervan et al.
9,382,716 B2 7/2016 Pervan et al.
9,388,584 B2 7/2016 Pervan et al.
9,428,919 B2 8/2016 Pervan et al.
9,453,347 B2 9/2016 Pervan et al.
9,458,634 B2 10/2016 Derelov
9,476,202 B2 10/2016 Clancy et al.
9,482,012 B2 11/2016 Nygren et al.
9,540,825 B2 1/2017 Ramachandra
9,540,826 B2 1/2017 Pervan et al.
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,822,533 B2 11/2017 Huang
9,856,656 B2 1/2018 Pervan
9,874,027 B2 1/2018 Pervan
9,945,130 B2 4/2018 Nygren et al.
9,951,526 B2 4/2018 Boo et al.
10,000,935 B2 6/2018 Kell
10,006,210 B2 6/2018 Pervan et al.
10,017,948 B2 7/2018 Boo
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelöv
10,352,049 B2 7/2019 Boo
10,358,830 B2 7/2019 Pervan
10,378,217 B2 8/2019 Pervan
10,458,125 B2 10/2019 Pervan
10,480,196 B2 11/2019 Boo
10,519,676 B2 12/2019 Pervan
10,526,792 B2 1/2020 Pervan et al.
10,538,922 B2 1/2020 Pervan
10,570,625 B2 2/2020 Pervan
10,640,989 B2 5/2020 Pervan
10,655,339 B2 5/2020 Pervan
10,669,723 B2 6/2020 Pervan et al.
10,724,251 B2 7/2020 Kell
10,731,358 B2 8/2020 Pervan
10,794,065 B2 10/2020 Boo et al.
10,828,798 B2 11/2020 Fransson
10,876,562 B2 12/2020 Pervan
10,933,592 B2 3/2021 Blomgren et al.
10,934,721 B2 3/2021 Pervan et al.
10,953,566 B2 3/2021 Fransson et al.
10,968,639 B2 4/2021 Pervan et al.
10,975,577 B2 4/2021 Pervan et al.
10,995,501 B2 5/2021 Pervan
11,045,933 B2 6/2021 Fransson et al.
11,053,691 B2 7/2021 Pervan
11,053,692 B2 7/2021 Pervan
11,060,302 B2 * 7/2021 Ylikangas ..... E04F 15/02038
11,066,835 B2 7/2021 Boo
11,078,673 B2 8/2021 Pervan et al.
11,091,920 B2 8/2021 Kell
11,131,099 B2 9/2021 Pervan
11,174,646 B2 11/2021 Pervan
11,193,283 B2 12/2021 Pervan et al.
11,261,608 B2 3/2022 Pervan
11,274,453 B2 3/2022 Pervan
11,326,353 B2 5/2022 Nilsson et al.
11,331,824 B2 5/2022 Myllykangas et al.
2001/0024707 A1 9/2001 Andersson et al.
2001/0034991 A1 11/2001 Martensson
2001/0045150 A1 11/2001 Owens
2002/0014047 A1 2/2002 Thiers
2002/0031646 A1 3/2002 Chen et al.
2002/0069611 A1 6/2002 Leopolder
2002/0092263 A1 7/2002 Schulte
2002/0095894 A1 7/2002 Pervan
2002/0108343 A1 8/2002 Knauseder
2002/0170258 A1 11/2002 Schwitte et al.
2002/0170259 A1 11/2002 Ferris
2002/0178674 A1 12/2002 Pervan
2002/0178680 A1 12/2002 Martensson
2002/0189190 A1 12/2002 Charmat et al.
2002/0189747 A1 12/2002 Steinwender
2002/0194807 A1 12/2002 Nelson et al.
2003/0009971 A1 1/2003 Palmberg
2003/0024199 A1 2/2003 Pervan et al.
2003/0037504 A1 2/2003 Schwitte et al.
2003/0066588 A1 4/2003 Pålsson
2003/0084636 A1 5/2003 Pervan
2003/0094230 A1 5/2003 Sjoberg
2003/0101674 A1 6/2003 Pervan
2003/0101681 A1 6/2003 Tychsen
2003/0145549 A1 8/2003 Palsson et al.

(56) References Cited

U.S. PATENT DOCUMENTS

2003/0180091 A1 9/2003 Stridsman
2003/0188504 A1 10/2003 Ralf
2003/0196405 A1 10/2003 Pervan
2004/0016196 A1 1/2004 Pervan
2004/0031225 A1 2/2004 Fowler
2004/0031227 A1 2/2004 Knauseder
2004/0049999 A1 3/2004 Krieger
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0137180 A1 7/2004 Sjoberg et al.
2004/0139676 A1 7/2004 Knauseder
2004/0139678 A1 7/2004 Pervan
2004/0159066 A1 8/2004 Thiers et al.
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hannig
2004/0238001 A1 12/2004 Risden
2004/0244325 A1 12/2004 Nelson
2004/0250492 A1 12/2004 Becker
2004/0261348 A1 12/2004 Vulin
2005/0003132 A1 1/2005 Blix et al.
2005/0028474 A1 2/2005 Kim
2005/0050827 A1 3/2005 Schitter
2005/0160694 A1 7/2005 Pervan
2005/0166514 A1 8/2005 Pervan
2005/0183370 A1 8/2005 Cripps
2005/0021081 A1 9/2005 Pervan
2005/0205161 A1 9/2005 Lewark
2005/0235593 A1 10/2005 Hecht
2005/0252130 A1 11/2005 Martensson
2005/0252167 A1 11/2005 Van Horne, Jr.
2005/0268570 A2 12/2005 Pervan
2006/0053724 A1 3/2006 Braun et al.
2006/0070333 A1 4/2006 Pervan
2006/0101769 A1 5/2006 Pervan
2006/0156670 A1 7/2006 Knauseder
2006/0174577 A1 8/2006 O'Neil
2006/0179754 A1 8/2006 Yang
2006/0185287 A1 8/2006 Glazer et al.
2006/0236642 A1 10/2006 Pervan
2006/0260254 A1 11/2006 Pervan et al.
2006/0272262 A1 12/2006 Pomberger
2007/0003366 A1 1/2007 Wedberg
2007/0006543 A1 1/2007 Engström
2007/0011981 A1 1/2007 Eiserman
2007/0022689 A1 2/2007 Thrush et al.
2007/0028547 A1 2/2007 Grafenauer
2007/0065293 A1 3/2007 Hannig
2007/0094969 A1 5/2007 McIntosh et al.
2007/0094985 A1 5/2007 Grafenauer
2007/0108679 A1 5/2007 Grothaus
2007/0113509 A1 5/2007 Zhang
2007/0151189 A1 7/2007 Yang et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1 1/2008 Pervan
2008/0000185 A1 1/2008 Duernberger
2008/0000186 A1 1/2008 Pervan et al.
2008/0000187 A1 1/2008 Pervan et al.
2008/0005998 A1 1/2008 Pervan
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0053029 A1 3/2008 Ricker
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0184646 A1 8/2008 Alford
2008/0199676 A1 8/2008 Bathelier et al.
2008/0216434 A1 9/2008 Pervan
2008/0216920 A1 9/2008 Pervan
2008/0236088 A1 10/2008 Hannig et al.
2008/0295432 A1 12/2008 Pervan et al.
2008/0295438 A1 12/2008 Knauseder
2008/0302044 A1 12/2008 Johansson
2009/0019806 A1 1/2009 Muehlebach
2009/0049787 A1 2/2009 Hannig
2009/0064624 A1 3/2009 Sokol
2009/0100782 A1 4/2009 Groeke et al.
2009/0126308 A1 5/2009 Hannig et al.
2009/0133353 A1 5/2009 Pervan et al.
2009/0151290 A1 6/2009 Liu
2009/0173032 A1 7/2009 Prager et al.
2009/0193741 A1 8/2009 Capelle
2009/0193748 A1 8/2009 Boo et al.
2009/0193753 A1 8/2009 Schitter
2009/0217615 A1 9/2009 Engstrom
2009/0241460 A1 10/2009 Beaulieu
2009/0249733 A1 10/2009 Moebus
2009/0308014 A1 12/2009 Muehlebach
2010/0018149 A1 1/2010 Thiers
2010/0043333 A1 2/2010 Hannig et al.
2010/0083603 A1 4/2010 Goodwin
2010/0170189 A1 7/2010 Schulte
2010/0173122 A1 7/2010 Susnjara
2010/0218450 A1 9/2010 Braun
2010/0275541 A1 11/2010 Prinz
2010/0281803 A1 11/2010 Cappelle
2010/0293879 A1 11/2010 Pervan et al.
2010/0031351 A1 12/2010 Tang
2010/0300029 A1 12/2010 Braun et al.
2010/0300031 A1 12/2010 Pervan et al.
2010/0319290 A1 12/2010 Pervan
2010/0319291 A1 12/2010 Pervan et al.
2011/0016815 A1 1/2011 Yang
2011/0030303 A1 2/2011 Pervan et al.
2011/0041996 A1 2/2011 Pervan
2011/0047922 A1 3/2011 Fleming, III
2011/0088344 A1 4/2011 Pervan et al.
2011/0088345 A1 4/2011 Pervan
2011/0088346 A1 4/2011 Hannig
2011/0094178 A1 4/2011 Braun
2011/0131916 A1 6/2011 Chen
2011/0138722 A1 6/2011 Hannig
2011/0154763 A1 6/2011 Bergelin et al.
2011/0162312 A1 7/2011 Schulte
2011/0167744 A1 7/2011 Whispell
2011/0167750 A1 7/2011 Pervan
2011/0167751 A1 7/2011 Engström
2011/0173914 A1 7/2011 Engström
2011/0197535 A1 8/2011 Baker et al.
2011/0225921 A1 9/2011 Schulte
2011/0225922 A1 9/2011 Pervan et al.
2011/0247285 A1 10/2011 Wybo et al.
2011/0252733 A1 10/2011 Pervan
2011/0271631 A1 11/2011 Engstrom
2011/0271632 A1 11/2011 Cappelle et al.
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0042598 A1 2/2012 Vermeulen et al.
2012/0055112 A1 3/2012 Engström
2012/0124932 A1 5/2012 Schulte et al.
2012/0151865 A1 6/2012 Pervan et al.
2012/0174515 A1 7/2012 Pervan
2012/0174519 A1 7/2012 Schulte
2012/0174520 A1 7/2012 Pervan
2012/0174521 A1 7/2012 Schulte et al.
2012/0192521 A1 8/2012 Schulte
2012/0222378 A1 9/2012 Cappelle et al.

(56) References Cited

U.S. PATENT DOCUMENTS

2012/0240502 A1 9/2012 Wilson et al.
2012/0279161 A1 11/2012 Håkansson et al.
2012/0304590 A1 12/2012 Engström
2012/0324816 A1 12/2012 Huang
2013/0008117 A1 1/2013 Pervan
2013/0008118 A1 1/2013 Baert et al.
2013/0014463 A1 1/2013 Pervan
2013/0019555 A1 1/2013 Pervan
2013/0025231 A1 1/2013 Vermeulen
2013/0025964 A1 1/2013 Ramachandra et al.
2013/0042562 A1 2/2013 Pervan
2013/0042563 A1 2/2013 Pervan
2013/0042564 A1* 2/2013 Pervan ..... E04F 15/02038 52/582.2
2013/0042565 A1 2/2013 Pervan
2013/0047536 A1 2/2013 Pervan
2013/0081349 A1 4/2013 Pervan et al.
2013/0111837 A1 5/2013 Devos et al.
2013/0111845 A1 5/2013 Pervan
2013/0145708 A1 6/2013 Pervan
2013/0152500 A1 6/2013 Engström
2013/0160391 A1 6/2013 Pervan et al.
2013/0167467 A1 7/2013 Vermeulen et al.
2013/0219806 A1 8/2013 Carrubba
2013/0232905 A2 9/2013 Pervan
2013/0239508 A1 9/2013 Pervan et al.
2013/0263454 A1 10/2013 Boo et al.
2013/0263547 A1 10/2013 Boo
2013/0283719 A1 10/2013 Döhring et al.
2013/0305650 A1 11/2013 Liu
2013/0309441 A1 11/2013 Hannig
2013/0318906 A1 12/2013 Pervan et al.
2014/0007539 A1 1/2014 Pervan et al.
2014/0020324 A1 1/2014 Pervan
2014/0026513 A1 1/2014 Bishop
2014/0033633 A1 2/2014 Kell
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0130437 A1 5/2014 Cappelle
2014/0140766 A1 5/2014 Riccobene et al.
2014/0144096 A1 5/2014 Vermeulen et al.
2014/0150369 A1 6/2014 Hannig
2014/0186104 A1 7/2014 Hamberger
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0283466 A1 9/2014 Boo
2014/0290173 A1 10/2014 Hamberger
2014/0305065 A1 10/2014 Pervan
2014/0338177 A1 11/2014 Vermeulen et al.
2014/0366476 A1 12/2014 Pervan
2014/0366477 A1 12/2014 Kell
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0047278 A1 2/2015 Blount
2015/0047284 A1 2/2015 Cappelle
2015/0059281 A1 3/2015 Pervan
2015/0089896 A2 4/2015 Pervan et al.
2015/0113908 A1 4/2015 Ramachandra et al.
2015/0121796 A1 5/2015 Pervan
2015/0152644 A1 6/2015 Boo
2015/0167318 A1 6/2015 Pervan
2015/0176289 A1 6/2015 Hannig
2015/0176619 A1 6/2015 Baker
2015/0211239 A1 7/2015 Pervan
2015/0233125 A1 8/2015 Pervan et al.
2015/0267419 A1 9/2015 Pervan
2015/0300029 A1 10/2015 Pervan
2015/0330088 A1* 11/2015 Derelov ..... E04F 15/02038 52/588.1
2015/0337537 A1 11/2015 Boo
2015/0337542 A1 11/2015 Cappelle et al.
2015/0368910 A1 12/2015 Kell
2016/0032596 A1 2/2016 Nygren et al.
2016/0060879 A1 3/2016 Pervan
2016/0069086 A1 3/2016 Hüllenkremer
2016/0069088 A1 3/2016 Boo et al.
2016/0076260 A1 3/2016 Pervan et al.
2016/0090744 A1 3/2016 Pervan et al.
2016/0153200 A1 6/2016 Pervan
2016/0160502 A1 6/2016 Brousseau
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0237695 A1 8/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0289984 A1 10/2016 Wagner
2016/0326751 A1 11/2016 Pervan
2016/0340913 A1 11/2016 Derelöv
2017/0030088 A1 2/2017 Simoens
2017/0037641 A1 2/2017 Nygren et al.
2017/0067261 A1 3/2017 Hannig et al.
2017/0079433 A1 3/2017 Derelöv et al.
2017/0081860 A1 3/2017 Boo
2017/0089379 A1 3/2017 Pervan
2017/0254096 A1 9/2017 Pervan
2017/0321433 A1 11/2017 Pervan et al.
2017/0328072 A1 11/2017 Hannig
2017/0362834 A1 12/2017 Pervan et al.
2018/0000151 A1 1/2018 Fransson
2018/0001509 A1 1/2018 Myllykangas et al.
2018/0001573 A1 1/2018 Blomgren et al.
2018/0002933 A1 1/2018 Pervan
2018/0016783 A1 1/2018 Boo
2018/0030737 A1 2/2018 Pervan
2018/0030738 A1 2/2018 Pervan
2018/0119431 A1 5/2018 Pervan et al.
2018/0155934 A1 6/2018 D'Hondt et al.
2018/0178406 A1 6/2018 Fransson et al.
2018/0313094 A1 11/2018 Pervan
2018/0362138 A1 12/2018 Gross
2019/0024387 A1 1/2019 Pervan et al.
2019/0048592 A1 2/2019 Boo
2019/0048596 A1 2/2019 Pervan
2019/0063076 A1 2/2019 Boo et al.
2019/0071879 A1 3/2019 Thiers
2019/0093370 A1 3/2019 Pervan et al.
2019/0093371 A1 3/2019 Pervan
2019/0119928 A1 4/2019 Pervan et al.
2019/0127989 A1 5/2019 Kell
2019/0127990 A1 5/2019 Pervan et al.
2019/0169859 A1 6/2019 Pervan et al.
2019/0232473 A1 8/2019 Fransson et al.
2019/0271165 A1* 9/2019 Boo ..... E04C 2/40
2019/0376298 A1 12/2019 Pervan et al.
2019/0394314 A1 12/2019 Pervan et al.
2020/0087927 A1 3/2020 Pervan
2020/0102756 A1 4/2020 Pervan
2020/0109569 A1 4/2020 Pervan
2020/0149289 A1 5/2020 Pervan
2020/0173175 A1 6/2020 Pervan
2020/0181923 A1* 6/2020 Quist ..... E04F 15/02005
2020/0224430 A1 7/2020 Ylikangas et al.
2020/0263437 A1 8/2020 Pervan
2020/0284045 A1 9/2020 Kell
2020/0318667 A1 10/2020 Derelöv
2020/0354969 A1 11/2020 Pervan et al.
2020/0412852 A9 12/2020 Pervan et al.
2021/0016465 A1 1/2021 Fransson

(56) References Cited

U.S. PATENT DOCUMENTS

| | | | |
|---|---|---|---|
| 2021/0047840 | A1 | 2/2021 | Pervan |
| 2021/0047841 | A1 | 2/2021 | Pervan et al. |
| 2021/0071428 | A1 | 3/2021 | Pervan |
| 2021/0087829 | A1* | 3/2021 | Ylikangas ..... E04F 13/0894 |
| 2021/0087831 | A1 | 3/2021 | Nilsson et al. |
| 2021/0087832 | A1 | 3/2021 | Boo |
| 2021/0087833 | A1 | 3/2021 | Ylikangas et al. |
| 2021/0087834 | A1 | 3/2021 | Ylikangas et al. |
| 2021/0310257 | A1* | 10/2021 | Boo ..... E04F 15/02038 |
| 2021/0348396 | A1 | 11/2021 | Pervan et al. |
| 2021/0381251 | A1* | 12/2021 | Svensson ..... F16B 5/0016 |
| 2022/0025657 | A1 | 1/2022 | Pervan |
| 2022/0025658 | A1 | 1/2022 | Kell |
| 2022/0143718 | A1 | 5/2022 | Pervan et al. |

FOREIGN PATENT DOCUMENTS

| | | | |
|---|---|---|---|
| DE | 138 992 | C | 7/1901 |
| DE | 142 293 | C | 7/1902 |
| DE | 2 159 042 | | 6/1973 |
| DE | 25 05 489 | A1 | 8/1976 |
| DE | 33 43 601 | A1 | 6/1985 |
| DE | 33 43 601 | C2 | 6/1985 |
| DE | 39 32 980 | A1 | 11/1991 |
| DE | 42 15 273 | A1 | 11/1993 |
| DE | 42 42 530 | A1 | 6/1994 |
| DE | 196 01 322 | A | 5/1997 |
| DE | 299 22 649 | U1 | 3/2000 |
| DE | 200 02 744 | U1 | 8/2000 |
| DE | 199 40 837 | A1 | 11/2000 |
| DE | 199 58 225 | A1 | 6/2001 |
| DE | 202 05 774 | U1 | 8/2002 |
| DE | 10 2004 001 363 | A1 | 8/2005 |
| DE | 10 2005 002 297 | A1 | 8/2005 |
| DE | 10 2006 024 184 | A1 | 11/2007 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 648 | A1 | 1/2009 |
| DE | 10 2007 049 792 | A1 | 2/2009 |
| DE | 10 2009 041 297 | A1 | 3/2011 |
| EP | 0 013 852 | A1 | 8/1980 |
| EP | 0 871 156 | A2 | 10/1998 |
| EP | 1 120 515 | A1 | 8/2001 |
| EP | 1 146 182 | A2 | 10/2001 |
| EP | 1 251 219 | A | 10/2002 |
| EP | 1 279 778 | A2 | 1/2003 |
| EP | 1 350 904 | A2 | 10/2003 |
| EP | 1 396 593 | A2 | 3/2004 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 980 683 | A2 | 10/2008 |
| EP | 2 000 610 | A1 | 12/2008 |
| EP | 2 236 694 | A1 | 10/2010 |
| EP | 2 270 291 | A1 | 1/2011 |
| EP | 2 278 091 | A2 | 1/2011 |
| EP | 2 333 195 | A1 | 6/2011 |
| EP | 2 388 394 | A2 | 11/2011 |
| EP | 2 333 195 | B1 | 7/2014 |
| EP | 2 734 684 | B1 | 8/2016 |
| FR | 1.138.595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | H03-110258 | A | 5/1991 |
| JP | H05-018028 | A | 1/1993 |
| JP | H06-146553 | A | 5/1994 |
| JP | H06-288017 | A | 10/1994 |
| JP | H06-306961 | A | 11/1994 |
| JP | H06-322848 | A | 11/1994 |
| JP | H07-300979 | A | 11/1995 |
| JP | 2900115 | B2 | 6/1999 |
| JP | 2002-047782 | A | 2/2002 |
| SE | 526 688 | C2 | 5/2005 |
| WO | WO 94/26999 | A1 | 11/1994 |
| WO | WO 96/27721 | A1 | 9/1996 |
| WO | WO 97/47834 | A1 | 12/1997 |
| WO | WO 98/22677 | A1 | 5/1998 |
| WO | WO 99/66151 | A1 | 12/1999 |
| WO | WO 99/66152 | A1 | 12/1999 |
| WO | WO 00/43281 | A2 | 7/2000 |
| WO | WO 00/47841 | A1 | 8/2000 |
| WO | WO 00/55067 | A1 | 9/2000 |
| WO | WO 01/02670 | A1 | 1/2001 |
| WO | WO 01/02672 | A1 | 1/2001 |
| WO | WO 01/07729 | A1 | 2/2001 |
| WO | WO 01/38657 | A1 | 5/2001 |
| WO | WO 01/44669 | A2 | 6/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 02/055809 | A1 | 7/2002 |
| WO | WO 02/055810 | A1 | 7/2002 |
| WO | WO 02/081843 | A1 | 10/2002 |
| WO | WO 02/103135 | A1 | 12/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/038210 | A1 | 5/2003 |
| WO | WO 03/044303 | A1 | 5/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/003314 | A1 | 1/2004 |
| WO | WO 2004/020764 | A1 | 3/2004 |
| WO | WO 2004/048716 | A1 | 6/2004 |
| WO | WO 2004/050780 | A2 | 6/2004 |
| WO | WO 2004/079128 | A1 | 9/2004 |
| WO | WO 2004/079130 | A1 | 9/2004 |
| WO | WO 2004/085765 | A1 | 10/2004 |
| WO | WO 2005/003488 | A1 | 1/2005 |
| WO | WO 2005/003489 | A1 | 1/2005 |
| WO | WO 2005/054599 | A1 | 6/2005 |
| WO | WO 2006/050928 | A1 | 5/2006 |
| WO | WO 2006/104436 | A1 | 10/2006 |
| WO | WO 2006/123988 | A1 | 11/2006 |
| WO | WO 2006/125646 | A1 | 11/2006 |
| WO | WO 2007/015669 | A2 | 2/2007 |
| WO | WO 2007/142589 | A1 | 12/2007 |
| WO | WO 2008/004960 | A2 | 1/2008 |
| WO | WO 2008/017281 | A1 | 2/2008 |
| WO | WO 2008/060232 | A1 | 5/2008 |
| WO | WO 2009/066153 | A2 | 5/2009 |
| WO | WO 2009/116926 | A1 | 9/2009 |
| WO | WO 2010/070472 | A2 | 6/2010 |
| WO | WO 2010/070605 | A2 | 6/2010 |
| WO | WO 2010/087752 | A1 | 8/2010 |
| WO | WO 2011/001326 | A2 | 1/2011 |
| WO | WO 2011/012104 | A2 | 2/2011 |
| WO | WO 2011/012105 | A1 | 2/2011 |
| WO | WO 2011/032540 | A2 | 3/2011 |
| WO | WO 2011/038709 | A1 | 4/2011 |
| WO | WO 2011/108812 | A2 | 9/2011 |
| WO | WO 2011/151758 | A2 | 12/2011 |
| WO | WO 2012/059093 | A2 | 5/2012 |
| WO | WO 2013/012386 | A1 | 1/2013 |
| WO | WO 2014/209213 | A1 | 12/2014 |
| WO | WO 2015/105449 | A1 | 7/2015 |

OTHER PUBLICATIONS

International Search Report and Written Opinion issued in PCT/SE2019/051280, dated Jan. 30, 2020, ISA/SE, Patent-och registreringsverket, Stockholm, SE, 14 pages.

(56) References Cited

OTHER PUBLICATIONS

Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages (VA033).
Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.
Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.
Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.
Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.
Engstrand, Ola (Contact)/Välinge Innovation AB, Technical Disclosure entitled "VA058 Rocker Tongue," IP com No. IPCOM000203832D, Feb. 4, 2011, IP.com Prior Art Database, 22 pages.
Pervan, Darko (Author)/Välinge Flooring Technology, Technical Disclosure entitled "VA066b Glued Tongue," IP com No. IPCOM000210865D, Sep. 13, 2011, IP.com Prior Art Database, 19 pages.
Pervan, Darko (Inventor)/Välinge Flooring Technology AB, Technical Disclosure entitled "VA067 Fold Slide Loc," IP com No. IPCOMO00208542D, Jul. 12, 2011, IP.com Prior Art Database, 37 pages.
Pervan, Darko (Author)/Välinge Flooring Technology, Technical Disclosure entitled "VA068 Press Lock VFT," IP com No. IPCOM000208854D, Jul. 20, 2011, IP.com Prior Art Database, 25 pages.
Pervan, Darko (Author), Technical Disclosure entitled "VA069 Combi Tongue," IP com No. IPCOM000210866D, Sep. 13, 2011, IP.com Prior Art Database, 41 pages.
Pervan, Darko (Author), Technical Disclosure entitled "VA070 Strip Part," IP com No. IPCOM000210867D, Sep. 13, 2011, IP.com Prior Art Database, 43 pages.
Pervan, Darko (Author), Technical Disclosure entitled "VA071 Pull Lock," IP com No. IPCOM000210868D, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
LifeTips, "Laminate Flooring Tips," available at (http://flooring.lifetips.com/cat/61734/laminate-flooring-tips/index.html), 2000, 12 pages.
Pervan, Darko, et al., U.S. Appl. No. 17/518,836 entitled "Mechanical Locking of Floor Panels vith a Flexible Bristle Tongue," filed Nov. 4, 2021.
Boo, Fredrik, et al., U.S. Appl. No. 17/697,334, entitled "Building Panel with a Mechanical Locking System," filed Mar. 17, 2022.

* cited by examiner

UNLOCKING SYSTEM FOR PANELS

CROSS REFERENCE TO RELATED APPLICATIONS

The present application is a continuation of U.S. application Ser. No. 16/713,373, filed on Dec. 13, 2019, now U.S. Pat. No. 11,060,302, which claims the benefit of Swedish Application No. 1950024-8, filed on Jan. 10, 2019. The entire contents of U.S. application Ser. No. 16/713,373 and Swedish Application No. 1950024-8 are hereby incorporated herein by reference in their entirety.

TECHNICAL FIELD

Embodiments of the present invention relates to a panels such as a building panels, floorboards, wall panels, ceiling panels, furniture components or the like, which are provided with a mechanical locking system.

TECHNICAL BACKGROUND

Building panels provided with a mechanical locking system comprising a displaceable and resilient tongue cooperating with a tongue groove for vertical locking are known and disclosed in, e.g., WO2006/043893 and WO2007/015669. The tongue is a separate part and is made of, e.g., plastic and inserted in a displacement groove at an edge of a panel. The tongue is pushed into the displacement groove during a vertical assembling of the panels and springs back into the tongue groove of an adjacent panel when the panels have reached a locked position.

Further known locking system comprises a tongue provided with, e.g., a wedge element. Two adjacent panels' edges are locked by displacing the tongue along the adjacent edges, see e.g., is disclosed in WO2008/004960.

A known system for unlocking panels comprises, and is disclosed in WO2014/209213.

Although WO2014/209213 provides a well-functioning system, there is still room for improvements.

The above description of various known aspects is the applicant's characterization of such, and is not an admission that any of the above description is considered as prior art.

SUMMARY

It is an object of certain embodiments of the present invention to provide an improvement over the above described techniques and known art. Particularly the ease of assembling and disassembling panels may be improved by embodiments of the inventive concept. Also, the inventive concept may bring about advantages in the manufacturing of the panels, in particular in terms of manufacturing tolerances of the edge-portions of the panels, as will become apparent herein.

At least some of these and other objects and advantages that will be apparent from the description have been achieved by aspects of the inventive concept. In a first aspect, there is provided a set of essentially identical panels, such as building panels, provided with a mechanical locking system comprising:

a displaceable tongue arranged in a displacement groove having a first opening at a first edge of a first panel. The tongue is configured to be displaced in the displacement groove along a displacement axis to attain a locking state wherein a first portion of the tongue cooperates with a first tongue groove having a second opening at a second edge of an adjacent second panel, for vertical locking of the first and the second edge. A second portion of the tongue is configured to cooperate with the second edge of the adjacent second panel via an elongated element for vertical unlocking of the first and the second edge.

The arrangement may bring about an advantage in that the tolerances necessary to achieve a reliable unlocking mechanism are provided by the tongue and the elongated element.

In one embodiment, a first engagement portion of the second portion is configured to engage with the elongated element and delimits an unlocking groove configured to receive the elongated element such as to cause the tongue to be displace along the displacement axis to attain an unlocking state for said vertical unlocking of the first and the second edge.

In a further embodiment, a second engagement portion of the second edge is configured to engage with the elongated element and delimits the unlocking groove, preferably the second engagement portion being provided external the first tongue groove, more preferably externally of and below the first tongue groove.

In a yet further embodiment, the first engagement portion and/or the second engagement portion are planar and extend in parallel or substantially in parallel, preferably side by side and in parallel. It may thereby be achieved that the elongated element is not urged in a transverse direction thereof, such as up or down. Also, linear translation of the tongue may be obtained.

In a still further embodiment, the unlocking groove is configured to attain the unlocking state upon receiving an elongated element having a constant cross-sectional width in the longitudinal direction of the elongated element.

The displacement groove may comprise a bottom surface, an upper surface and a lower surface, preferably the lower surface being parallel to the upper surface and/or parallel to the displacement axis of the tongue.

In one embodiment, the second engagement portion extends below a plane of the lower surface.

A dimension in the direction of a normal of a plane of the lower surface, between the lower surface and the first portion, may correspond at least to a maximum diameter of the elongated element, such as a maximum diameter of a portion of the elongated element intended to be received in the unlocking groove.

In one embodiment, a dimension in the direction of the normal of a plane of the lower surface, between the lower surface and the first portion, corresponds at least to a dimension along the displacement axis between the first engagement portion and an outermost point of the tongue.

A dimension in the direction of the normal of the plane of the lower surface, between the said plane and the first portion may correspond at least to a distance, such as a greatest distance, along the displacement axis between the second engagement portion and an outermost point of the tongue in the locking state, preferably the said greatest distance is measured between an outermost point of the second engagement portion and an outermost point of the tongue.

The dimension in the direction of a normal of a plane of the lower surface, between the lower surface and the first portion may be measured between a point on a lower surface of the first portion of the tongue, said point being aligned, in the direction of the normal of the plane of the lower surface, with an uppermost point of the elongated element.

In one embodiment, the second portion and the diameter of the elongated element are configured to cooperate such that the tongue is displaced along the displacement axis at least to the extent that an outermost point of the second engagement portion and an outermost point of the first portion do not overlap, preferably to the extent that there is provided a play in a horizontal plane between the outermost point of the second engagement portion and the outermost point of the first portion.

The second portion may comprise a chamfered edge portion forming a guiding surface configured to guide the elongated element in the transverse direction of the tongue, preferably a chamfered longitudinal edge portion.

In one embodiment, the second edge comprises a chamfered edge portion for guiding said elongated element towards the tongue.

The elongated element may have a rotationally symmetric cross-section in a transverse plane thereof, by an angle of less than 120 degrees, preferably less than 90 degrees, more preferably being circular.

The locking system may be configured such that in the unlocking state, the elongated element is at least partially arranged in the displacement groove.

An engagement direction may be directed downwards and in parallel with vertical plane formed by an upper part of the first edge and an upper part of the second edge.

In the locking state, the first portion of the tongue may be configured to protrude from the displacement groove and/or from the first edge, such as an upper part thereof, a distance along the horizontal plane, which may be transverse the engagement direction, not greater than the distance between a lower surface of the displacement groove and the first portion of the tongue in the direction of a normal of the lower surface of the displacement groove.

In one embodiment, the unlocking groove is disposed at least partially between the tongue groove and the lower surface of the displacement groove.

In one embodiment, the second engagement portion forms part of a second unlocking surface of the second edge facing a first unlocking surface of the second portion of the tongue. The second unlocking surface may extend in an engagement direction and at least passed a mid-point between the first portion of the tongue and the plane of the lower surface of the displacement groove. The second unlocking surface may extend at least to the plane of the lower surface of the displacement groove. The first and second unlocking surfaces may be planar and/or vertical. Optionally, the first and second unlocking surfaces may each have an extension configured such that the elongated element is not urged to displace in the engagement direction above or below the displacement groove.

The extension of the second portion in a direction along the normal of the lower surface of the displacement groove may exceed the extension of the first portion in a direction along the said normal.

The first engagement portion may be provided at a recess of the tongue. The recess may be provided between the first portion and the lower surface of the displacement groove.

The recess may have a concave shape. An advantage of providing the recess with a concave shape may be that the elongated element maintains a desired position in the unlocking groove, such as during insertion of the elongated element in the unlocking groove and/or during disassembling of the first and second panel.

The first opening and the second opening are preferably horizontally open and a vertical height of the first opening is preferably greater than a vertical height the second opening.

A maximum height of the displacement groove may be greater than a maximum height of the first tongue groove. The maximum height of the first tongue groove may be in the range of about 20% to about 75% of the maximum height of the displacement groove, preferably in the range of about 20% to about 50% of the maximum height of the displacement groove.

The mechanical locking system may comprise a first locking strip, at the first or the second edge, provided with a first locking element configured to cooperate for horizontal locking with a first locking groove at the other of the first or second edge.

The panels may be floorboards, wall panels, ceiling panels, a furniture component or the like.

The core of the panels may be a wood-based core, preferably made of MDF, HDF, OSB, WPC, plywood or particleboard. The core may also be a plastic core comprising thermosetting plastic or thermoplastic e.g. vinyl or PVC. The plastic core may comprise fillers. The thinner first tongue groove may, for a panel with a core comprising plywood, be easier to arrange at a favorable position in relation to the layers in the plywood core.

The front face, such as an upper surface, of the panels is preferably provided with a decorative layer and the back face is preferably provided with a balancing layer.

The edge of the panels, of which parts of the locking system, such as the first and the second locking strip, the first and the second locking element, the first and the second locking groove, the displacement groove and the first and the second tongue groove, may be made, may be comprised of one or more of the above-mentioned core materials.

In a second aspect, the inventive concept pertains to a kit comprising the set according to any one of the embodiments of the first aspect and an elongated element configured for vertical unlocking of the first and second edge.

In a third aspect, the inventive concept pertains to a method for vertical unlocking a set of essentially identical panels, such as building panels, provided with a mechanical locking system comprising:

a displaceable tongue arranged in a displacement groove having a first opening at a first edge of a first panel, the tongue configured to be displaced in the displacement groove along a displacement axis to attain a locking state wherein a first portion of the tongue is configured to cooperate with a first tongue groove with a second opening at a second edge of an adjacent second panel, for vertical locking of the first and the second edge; and wherein the method comprises: inserting an elongated element in an unlocking groove delimited by a first engagement portion of the second portion of said tongue and further delimited by a second engagement portion of the second edge of the second panel disposed externally the tongue groove, to thereby cause the tongue to be displaced along the displacement axis to attain an unlocking state for vertical unlocking of the first and the second edge.

In a fourth aspect, the inventive concept pertains to a device 69 for unlocking a mechanical locking system of building panels assembled by means of the mechanical locking system. The mechanical locking system configured for horizontal and vertical locking of adjacent building panels. The locking system comprising at a first edge of a first building a displaceable locking tongue configured to displace in a displacement groove provided in the first edge of the first building panel. The locking tongue being configured to displace between a locking position and an unlocking position. In the locking position, the locking tongue is configured in a protruding position wherein protruding from the displacement groove for cooperating with a tongue groove provided in an adjacent edge of a second adjacent building panel. In the unlocking position, the locking tongue is configured in a retracted position. The unlocking device comprises an elongated element (70) and a positioning element (71). The positioning element is configured to be received in the displacement groove.

Further embodiments and advantages being described in following description and the appended claims.

BRIEF DESCRIPTION OF THE DRAWINGS

The present invention will by way of example be described in more detail with reference to the appended schematic drawings, which shows embodiments of the present invention.

FIGS. 11A-11C schematically illustrate a method of disassembling assembled building panels, according to an embodiment of the inventive concept, wherein: FIG. 11A shows two assembled building panels and the device of FIG. 9A arranged in a displacement groove of one of the building panels; FIG. 11B shows at least a portion of the elongated element of the device of FIG. 9A having been inserted in an unlocking groove shown in FIG. 11A; FIG. 11C shows a first and second building panel being disassembled by means of a vertical displacement of a second edge of a second panel relative a first edge of a first panel.

DETAILED DESCRIPTION

Figure 1A:
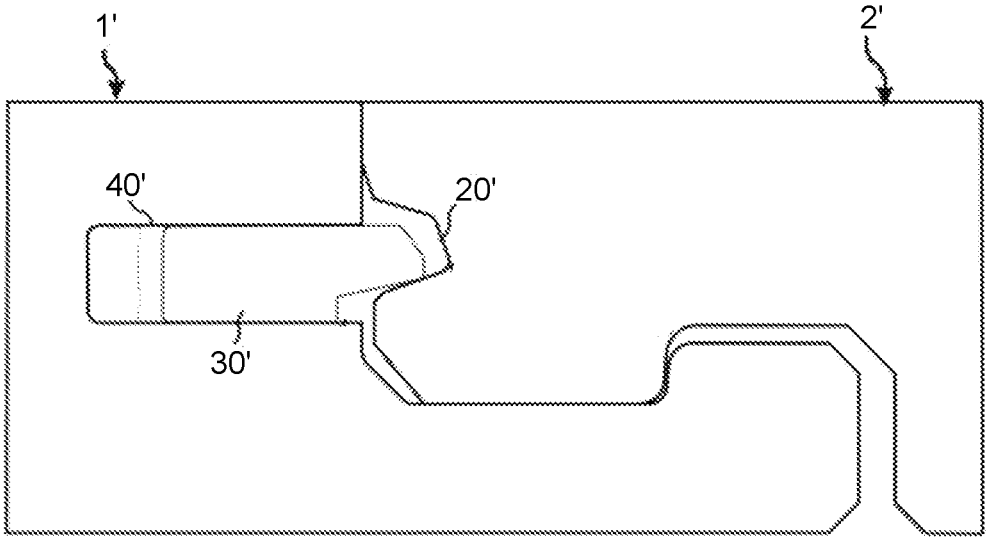
Prior art FIG. 1A
FIG. 1A-1B show cross sections of known locking systems with a separate and displaceable tongue.
Figure 1B:
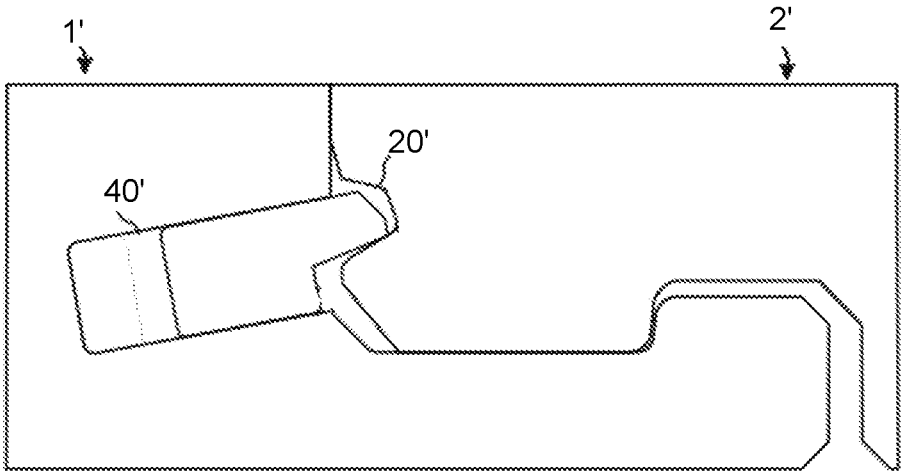
FIG. 1B Prior art

A known mechanical locking system for building panels, which comprises a displaceable tongue 30' cooperating with a first tongue groove 20' for vertical locking of a first edge of a first panel 1' with a second edge of a second panel 2' is shown in FIGS. 1A-1B. The tongue 30' is a separate part and is made of, e.g., plastic, and inserted in a displacement groove 40' at the first edge of the first panel 1'. The tongue 30' is pushed into a displacement groove 40' during a vertical assembling of the first and the second edges of the panels 1', 2' and springs back into a first tongue groove 20' at the second edge of the second panel 2' when the panels have reached a locked position. A third and a fourth edge of the panels are provided with a locking system, which enables assembling to an adjacent panel (not shown) by an angling movement, to obtain a simultaneous assembling of the first and the second edges and the third and the fourth edges.

Embodiments of the inventive concept are shown in FIGS. 2A-2B, 3A-3C, 4A-4B, 5A-5B, 6, 7A-7B, 8A-8C, 9A-9D, 10, and 11A-11C. A locking system is formed at a first edge 11 of a first panel 1, and a second edge 22 of an adjacent second panel 2 for locking the first 11 and the second edges 22 in a vertical and/or horizontal direction.

Figure 2A:
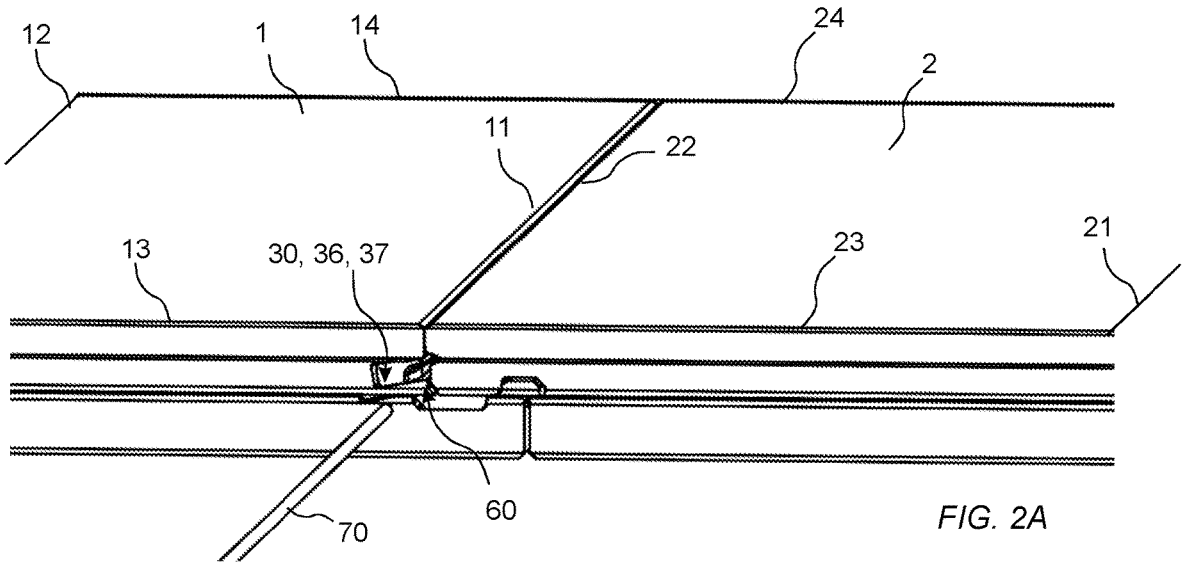
FIGS. 2A-2B show a perspective view of panels according to embodiments of the inventive concept.
Figure 2B:
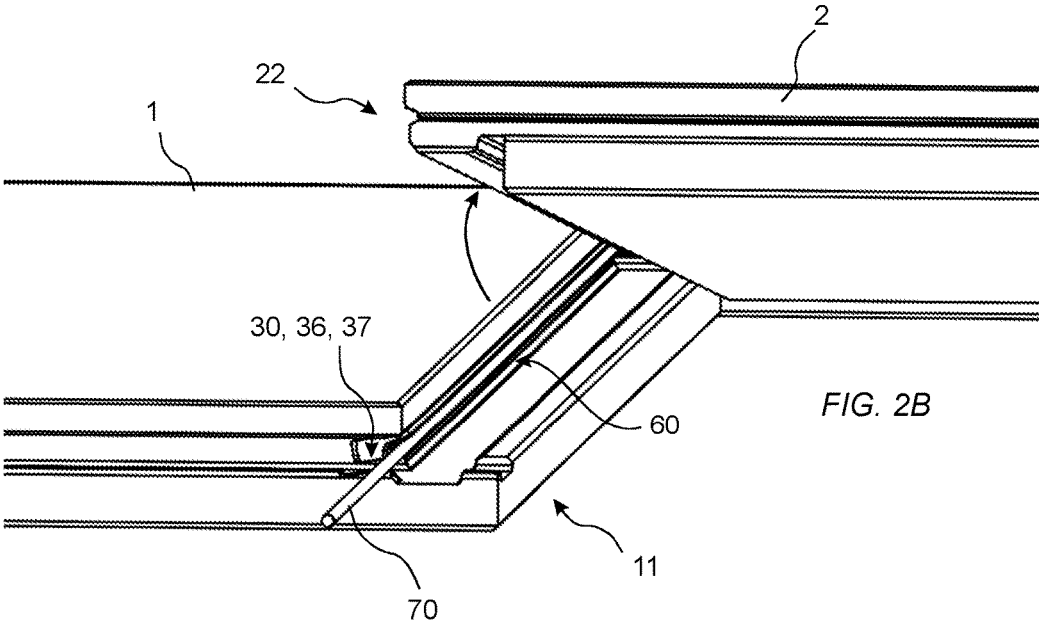

FIGS. 2A-2B show an illustration of an embodiment of the inventive concept comprising a mechanical locking system comprising a dedicated unlocking groove 60 configured to receive an elongated element 70 for vertical unlocking of the first and second edges 11, 22.

Figure 3A:
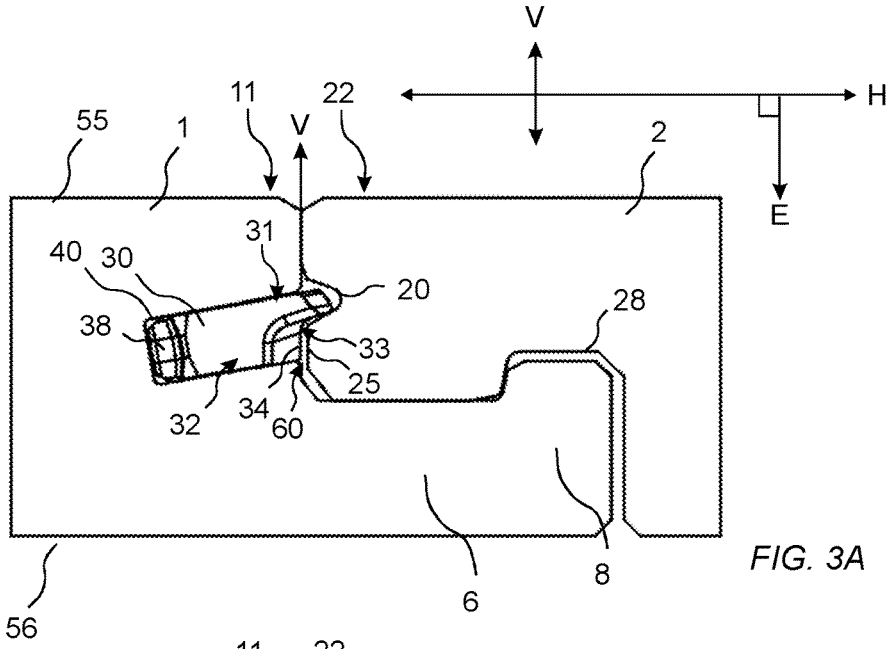
FIGS. 3A-3B show schematic side-views of panels according to an embodiment of the inventive concept.
Figure 3B:
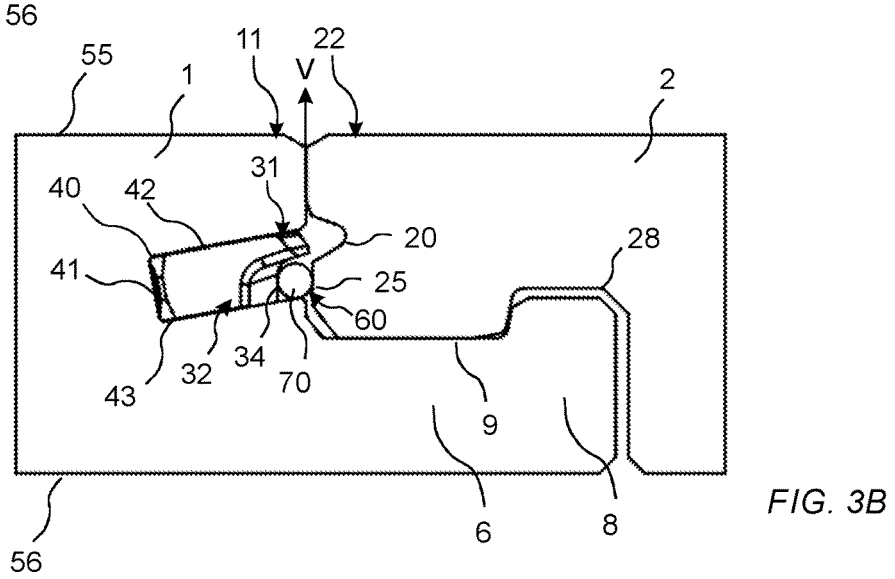

FIGS. 3A-3B show side views of embodiments of the displaceable tongue 30 during unlocking of a first and a second panel 1, 2.

An upper part of the first edge 11 and an upper part of the second edge 22 may form a vertical plane V.

The second panel 2 with the first tongue groove 20 is lowered in relation to the second panel 2 with the displaceable tongue 30, which is pushed into a displacement groove 40 by the lowered panel 2. The displaceable tongue 30 springs back, and into the first tongue groove 20, when the panels have reached an assembled position, and locks the first 1 and the second 2 panels vertically.

An embodiment of the locking system enables assembling of panels at the adjacent edges by a vertical movement. The locking system is preferably formed by mechanical cutting, such as milling, drilling and/or sawing, of the edges of the panels and provided with a displaceable tongue 30, preferably made of a polymer-based material such as thermoplastic, alternatively the tongue 30 may be made of metal. The displaceable tongue 30 may be bendable and may be provided with protruding flexible parts, such as biasing feathering means. Obtaining small satisfactory tolerances in the forming of the locking system, in particular the machining of the panels, are typically costly and time consuming. Embodiments of the present disclosure may facilitate that manufacturing tolerances of the locking system may be essentially provided by the tongue 30 and the deactivating elongated element 70, such as a stick. The stick may be made of a stiff and bendable material, such as metal. The tongue 30 and the elongated element 70 may thus be manufactured such that the elongated element 70 may cause displacement of the tongue 30 in the unlocking direction to the extent that play dH (See FIG. 4B) in the direction of the plane H, such as a horizontal plane, is provided between the first portion 31 of the tongue 30 and a second engagement portion 25 independent of the tolerances of the first 11 and second edge 22, for vertical unlocking of the first and second edges 11, 22. In some embodiments, dH may be zero. Thereby, embodiments of the inventive concept may provide for improvements in terms of cost-efficiency since it may be less costly to manufacture the tongue 30 and the deactivating elongated element 70 with high precision.

The displaceable tongue 30 is arranged in the displacement groove 40 at the first edge 11 of the first panel 1. The tongue 30 cooperates with a first tongue groove 20, which is formed at the second edge 22 of a second panel 2, for vertical locking of the panel 1, 2. A corresponding configuration may be provided at a first edge 21 of the second panel 2. A first locking strip 6 with a vertically protruding first locking element 8 is formed in the first edge 11 of the first panel 1. The locking element 8 cooperates with a first locking groove 28, formed in the second edge 22 of the second panel 2, for horizontal locking of the panels 1, 2.

The tongue 30 may be displaceable in the displacement groove 40 along a displacement axis Ax corresponding to a locking direction to attain a locking state wherein a first portion 31 of the tongue 30 is configured to cooperate with the first tongue groove 20 having an opening at a second edge 22 of an adjacent panel, such as second panel 2, for vertical locking of the first edge 11 and the second edge 22.

The tongue 30 may be displaced in the displacement groove 40, in particular, a first portion 31 and a second portion 32 of the tongue 30 are configured to be displaced inside the displacement groove 40. The first 31 and second 32 portions of the tongue 30 may form an integral body. The tongue 30 may be linearly translated in the displacement groove 40. Linear translation may include a minor amount of non-linear translation, such that the translation is primarily linear.

As shown for instance in FIGS. 3A-3B and 4A-4B, the displacement groove 40 comprises a bottom surface 41, an upper surface 42 which may be disposed adjacent the first portion 31 of the tongue 30, and a lower surface 43 which may be disposed adjacent the second portion 32 of the tongue 30. Plane Px of the lower surface 43 may be parallel to a displacement axis Ax. Consequently, the tongue 30 may be displaced along the displacement axis Ax relative to and/or against the lower surface 43, optionally also the upper surface 42. The tongue 30 may be displaced, typically linearly translated, along the displacement axis Ax in a locking direction to attain the locking state and in an unlocking direction to attain an unlocking state, as will be explained herein. Typically, the tongue 30 at least to some extent rests on the bottom surface 43. Accordingly, the direction of the normal Ny of the plane Px of the bottom surface 43 thus extends transverse or with a right-angle relative the plane Px in a direction towards the upper surface 42 of the displacement groove 40.

The first portion 31 may comprise or constitute an upper and outer portion of the tongue 30 and the second portion 32 may comprise or constitute a lower and outer portion of the tongue 30. In this context, "upper" may refer to adjacent the upper surface 42 of the displacement groove 40, correspondingly "lower" may refer to adjacent the lower surface 43 of the displacement groove 40 and "outer" may refer to opposite the bottom surface 41 of the displacement groove 40.

As shown in FIGS. 3A-4B, the displacement axis Ax, and thus also the displacement groove 40, may be inclined an angle φ relative a horizontal plane H. Typically, the plane of the first panel 1 and/or an upper 55 surface and/or a lower 56 surface of the panel may be parallel the horizontal plane H. The upper surface 55 of the panel 1, 2 may be a visible surface. The displacement groove 40 may be inclined downwards, such as in the engagement direction E, as the displacement groove 40 extends into the first panel 1, as shown in FIGS. 3A-4B.

FIG. 3A shows the tongue 30 in the locking state. In the locking state, at least the first portion 31 of the tongue 30 protrudes outside the displacement groove 40 and at least partially into the tongue groove 20. The first portion 31 may comprise a protruding tongue nose of the displaceable tongue 30.

The second portion 32 may or may not protrude outside the displacement groove 40, typically the second portion 32 does not or does not substantially protrude from the displacement groove 40 in the locking state and/or the unlocking state.

The first portion 31 may have an extension along the displacement axis Ax exceeding that of the second portion 32. The second portion 32 may have an extension in the normal direction Ny exceeding that of the first portion 31.

The tongue 30 further comprises a recess 33, which may recess inwards underneath the tongue nose of the tongue 30 to form a concavity extending in the longitudinal direction of the tongue 30, such as the longest extension of the tongue 30. It follows that there may be a gradual curved transition between the first portion 31 and the second portion 32 as illustrated in FIGS. 3A-B which curve may have a radius of curvature configured to substantially correspond to a radius of the elongated element 70. The recess 33 may at least partially surround the unlocking groove 60.

The second portion 32 of the tongue 30 of the first panel 1, provided adjacent the first portion 31, may be configured to cooperate with an edge portion of an adjacent second panel 2 for vertical unlocking of the first 1 and second 2 panels. The second portion 32 of the tongue 30 may be provided above or below the protruding tongue nose, preferably below the first portion 31 in the engagement direction, such as downwards in FIGS. 3A-3B, 4A-4B. More in particular, the second portion 32 is configured to cooperate with a portion of the second edge 22 via an elongated element 70 which may abut the second portion 32 and the second edge 22 simultaneously. The second portion 32 comprises a first engagement portion 34 and the second edge 22 comprises a second engagement portion 25 for engaging the elongated element 70.

The mechanical locking system comprises an unlocking groove 60 for vertical unlocking of the first edge 11 of the first panel 1 and the second edge 22 of an adjacent panel, such as the second panel 2.

As shown in FIGS. 2A-B, the first edge 11 and the second edge 12 of the first panel 1 may be the short edges of a panel, such as the first panel 1, and the third edge 13 and the fourth edge 14 may be the long edges of a panel, such as the first panel 1. This may apply mutatis mutandis for an adjacent panel, such as the second panel 2 having respective first 21, second 22, third 23, and fourth edges 24.

The unlocking groove 60 is delimited by surfaces of elements, such as two, three or four surfaces, provided by portions of one or more of the first portion 31 of the tongue 30, the second portion 32 of the tongue 30, the second edge 22 of the second panel 2 and the lower surface 43 of the displacement groove 40.

Thus, the second portion 32, the second edge 22 and the lower surface 43 of the displacement groove 40 may form the unlocking groove 60 configured to receive the elongated element 70.

Typically, the unlocking groove 60 is delimited in the normal direction Ny by means of the first portion 31 of the tongue 30, such as the protruding tongue nose, and further delimited by the second portion 32 of the tongue 30 and by a portion of the second edge 22 of the second panel 2.

The unlocking groove 60 is configured to receive an elongated element 70 such that the tongue 30 is displaced along the displacement axis in an unlocking direction, to attain an unlocking state as shown in FIG. 3B.

Upon insertion of the elongated element 70 in the unlocking groove 60, the tongue 30 is thus caused to displace or linearly translate inside the displacement groove 40 in response to the insertion, i.e. under the action of the elongated element 70 engaging the tongue 30 and urging the tongue 30 to displace along the displacement direction Ax.

The second portion 32 of the tongue 30 comprises a first engagement portion 34 for direct engaging or cooperating with the elongated element 70, such as with an outer circumference of the elongated element 70.

The second edge 22 of the second panel 2 may comprise a second engagement portion 25 (See FIG. 4A) provided exterior the tongue groove 20, preferably below the tongue groove 20. The second engagement portion 25 may provide for direct engaging or contact with the elongated element 70, such as a circumference of the elongated element 70. The first edge 11 of the first panel 1 may comprise a first engagement portion 34. The first engagement portion 34 may provide for direct engaging or contact with the elongated element 70, such as a circumference of the elongated element 70.

The first engagement portion 34 and/or the second engagement portion 25 may be planar and/or may extend vertically. The first engagement portion 34 and the second engagement portion 25 may extend side by side and/or in parallel. Preferably, the first engagement portion 34 and the second engagement portion 25 are planar and extends side by side in parallel.

During a vertical assembling of the panels, the second engagement portion 25 may be configured to engage with the first portion 31 of the tongue 30 such as to push back the tongue 30 in an unlocking direction along the displacement axis Ax into the displacement groove 40.

Figure 4A:
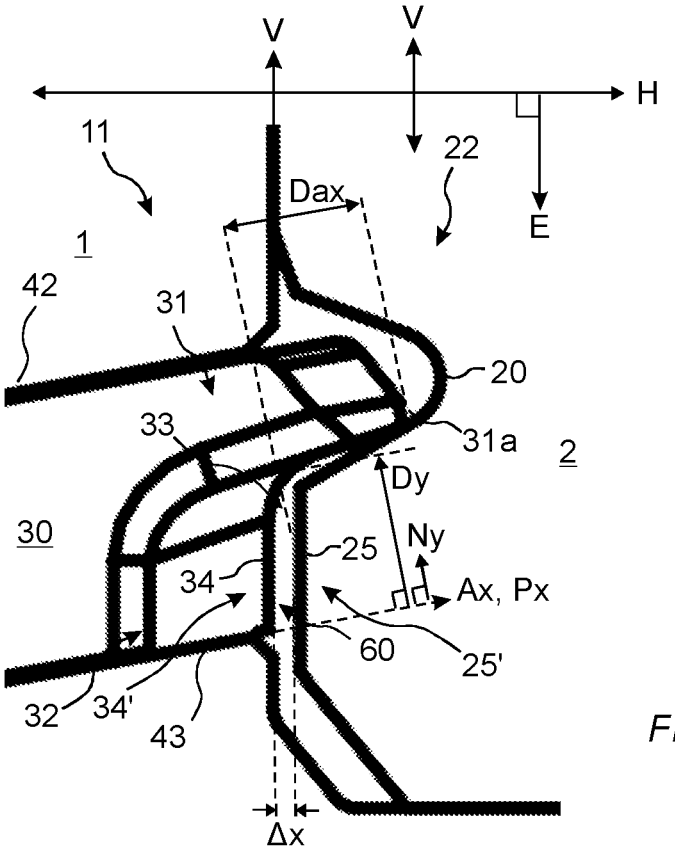
FIGS. 4A-4C show cross-sectional views of the panels of FIG. 3A-B.
Figure 4B:
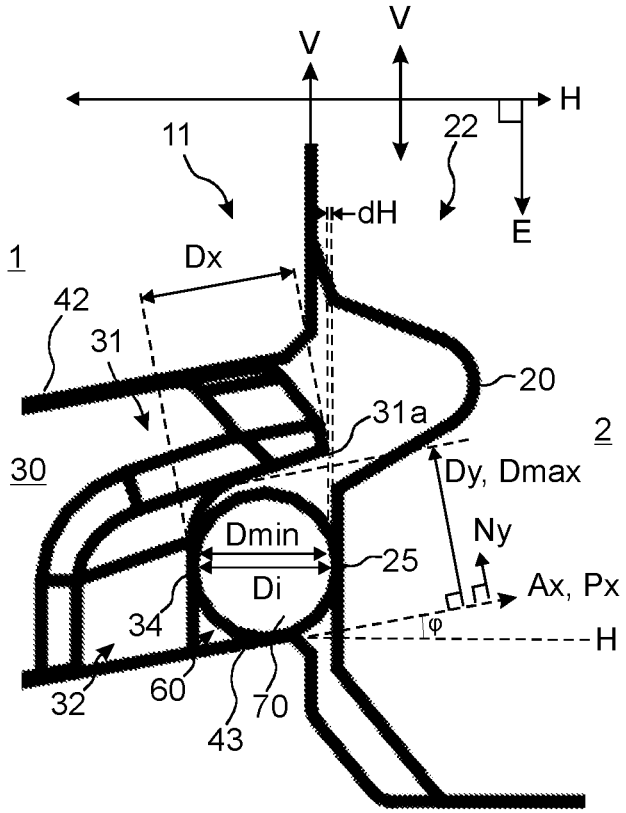

The unlocking groove 60 may be configured such that the extension thereof in the direction Ny of the normal corresponds to at least the distance between the first engagement portion 34 and the second engagement portion 25 in the unlocking position as shown in FIG. 4B.

Typically, in the locking state, the unlocking groove 60 is configured such that the first engagement portion 34 and the second engagement portion 25 are provided to have an extension above the lower surface 43 of the displacement groove 40. For example, the first engagement portion 34 and the second engagement portion 25 are provided to have an extension at least at a distance above the lower surface 43 of the displacement groove 40 substantially corresponding to half the distance between the first and second engagement portions 34, 25 in the unlocking state or for example the first engagement portion 34 and the second engagement portion 25 are provided to have an extension at least at a distance above the lower surface 43 of the displacement groove 40 substantially corresponding to half the distance between the plane Px and the first portion 31 of the tongue 30 in the Ny direction inside the unlocking groove 60. The second engagement portion 25 may have an extension below a first opening of the displacement groove 40 at the first edge 11.

The second portion 32 of the tongue 30 may be disposed exterior the tongue groove 20 in the locking state and/or unlocking state.

In particular, the first engagement portion 34 may be disposed exterior the tongue groove 20 in the locking state and/or in the unlocking state.

The unlocking groove 60 may be configured such that the tongue 30 is displaced in an unlocking direction to attain an unlocking state upon receiving the elongated element 70 which is preferably rotational symmetric, such as rotational symmetric under an angle of 120, 90, 72, 60, 45, 36, 30 degrees, preferably rotational symmetric under an angle of 120, more preferably under 90, most preferred being circular.

This arrangement brings about several advantageous effects, including that the elongated element 70 can be inserted in the unlocking groove 60 with reduced frictional resistance which may otherwise cause bending of the elongated element 70.

Further, in the unlocking state when the respective first and second engagement portions 34, 25 are engaged with engagement element 70, the arrangement provides the function of a needle bearing and thus functions as a needle bearing as the second panel 2 is displaced in a direction opposite the engagement direction E, such as a vertical direction, causing the elongated element 70 to rotate or slide against the first engagement portion 34 and/or the second engagement portion 25.

It should be appreciated that as the angle of rotational symmetry decreases the effective contact surfaces, i.e. frictional surfaces, between the elongated element 70 and the respective engagement portions 34, 25 are reduced. Accordingly, in a preferred embodiment the elongated element 70 has a circular cross section in a transverse direction thereof, such as the shortest extension. In this embodiment, the circumference of the elongated element 70 may be tangent with the first and second engagement portions 34, 25 only along a respective incremental contact surface of the first and second engagement portions 34, 25. In other words, the circumference of the elongated element 70 and surfaces of the locking groove 60, i.a. the lower surface 43, the first and second unlocking surfaces 34', 25' of the locking system may substantially not be parallel in a transverse T plane of tongue 30, with exception for the contact surfaces.

Embodiments of the disclosed inventive concept enable a deactivating elongated element 70, such as a round stick, or substantially round stick to be used for unlocking the first and second edge 11, 22.

Thus, embodiments of the disclosed inventive concept may provide for synergistic effects; by providing the unlocking groove 60 exterior the tongue groove 20, the use of a deactivating element which substantially round or round, preferably circular, to be used for unlocking the first and second edge 11, 22 is facilitated. The round shape of the deactivating elongated element 70 may substantially reduce frictional forces associated with disassembling of the panels, such as the first and second panels 1, 2 and thus may facilitate easy vertical disassembling.

The longitudinal length of the elongated element 70, such as the longest extension thereof, may correspond to at least a short side of the panel 1 and/or the length of the first edge 11 and/or in some embodiments a length sufficient to cause the entire length of the tongue 30 to attain the unlocking state, such as if the first edge 11 corresponds to a long side of a panel configured to form part of a herringbone-pattern floating floor, as will be described herein. In such case, the tongue 30 may optionally extend only in a portion of the displacement groove 40 of the long side of such panel (see FIGS. 7A-7B and 8A-8C).

The first engagement portion 34 and second engagement portion 25 may abut or may be arranged flush with each other or may be spaced apart by a distance Δx in the locking state, as shown e.g. in FIG. 4A.

Referring to FIGS. 4A-4B, the locking system of FIGS. 3A-3B are shown more in detail. FIG. 4A illustrates the panels in locking state and FIG. 4B the unlocking state. As derivable from FIGS. 4A-4B, the displacement groove 40 comprises a bottom surface 41, an upper surface 42 and a lower surface 43, the lower surface 43 being parallel a displacement axis Ax of the tongue 30. Thus, the tongue 30 may displace and/or linearly translate parallel the lower surface 43. The displacement axis Ax may be parallel the plane Px of the lower surface 43. As the tongue displaces in the locking direction and the unlocking direction respectively, the tongue 30 may be displaced along the displacement axis Ax. The tongue 30 may be displaced against or along the lower surface 43 and/or upper surface 42 of the displacement groove 40.

A normal Ny of the plane Px extends in a direction transverse the plane Px as shown in FIGS. 4A-4B.

In the locking state, the first portion 31 may be wedged between the upper surface 42 of the displacement groove 40 and a lower surface of the tongue groove 20, as shown in FIG. 4A.

An upper surface and/or lower surface of the tongue 30 may be substantially planar, or planar.

The first portion 31 of the tongue 30 may extend essentially along the displacement axis Ax, and may optionally have a substantially constant thickness in the direction of the normal Ny.

As schematically shown in FIG. 4B, a dimension Dy in the direction of the normal Ny may be measured between the plane Px and the first portion 31, such as an underside of the protruding tongue nose.

Dy may be measured in the unlocking groove 60 in unlocking state.

Dy may correspond at least to a maximum diameter Dmax of the elongated element 70.

The dimension Dy in the direction of the normal Ny of the plane Px, between the lower surface 43 and the first portion 31, may correspond at least to a dimension Dx along the displacement axis Ax between the first engagement portion 34 and an outermost point 31*a* of the tongue 30.

As derivable from FIG. 4A illustrating the locking state, the dimension along the displacement axis Ax between the outermost tip point 31*a* of the tongue 30 and the outermost point of the second engagement portion 25, is denoted Dax. By the outermost tip point 31*a* of the tongue 30 is meant in a direction away from the first edge 11 in a direction along the horizontal plane H. By outermost point of the second engagement portion 25 is meant in a direction away from the second edge 22 in a direction along the horizontal plane H. It follows that in order for the tongue 30 to obtain an unlocking state, i.e. such that the second engagement portion 25 and the tip point 31*a* do not overlap in a direction along the engagement direction E, the tongue 30 should to displace at least a distance Dax in the unlocking direction along the displacement axis Ax. When the second engagement portion 25 and the tip point 31*a* do not overlap, the tongue is in the unlocking position and the second edge 22 of the second panel 2 may be disassembled from the first panel 1 by means of a displacement of the second edge in a direction being opposite the engagement direction E, i.e. a vertical displacement. This means the first edge 11 and the second edge 22 may essentially not displace horizontally relative each other during the vertical displacement, as shown in FIG. 2B, in other words, the horizontal relationships between features of the first edge 11 and the second edge 22 may not change during the disassembling. Therefore, starting from the locking state shown in FIGS. 3A and 4A, for unlocking the mechanical locking system it may suffice to displace the locking tongue 30 such that an outermost point of second engagement portion 25 and the outermost tip point 31*a* do not overlap in a direction along the engagement direction E when the first and second panel 1, 2 are adjacent as shown in FIGS. 3A and 4A.

Figure 4C:
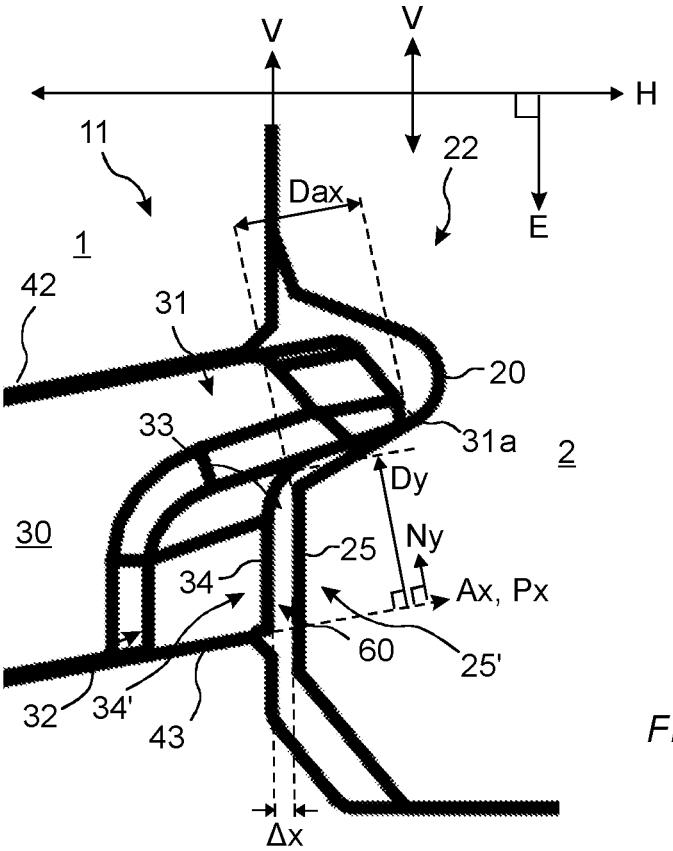

In some embodiments, there may be no play in the horizontal plane H, between the second engagement portion 25 and the tip point 31*a*. As derivable from FIG. 4A, dimension Dax is indicated as being measured from approximately half the extent of the second engagement portion 25 in order to provide play dH, however if the tongue is to be displaced such that there is zero play, Dax may be measured as the shortest distance between along the displacement axis Ax between the outermost tip point 31*a* of the tongue 30 and the second engagement portion 25, as illustrated in FIG. 4C.

Consequently, a minimum cross-sectional diameter Dmin of the elongated element 70 may displace the tongue 30 at least the distance Dax along the displacement axis Ax, i.e. in the unlocking direction.

Accordingly, the unlocking groove 60 may be configured such that the tongue 30 is displaced in the unlocking direction a distance Dax in response to receiving an elongated element 70 of diameter Di, which may be a constant cross-sectional diameter, such that the tongue 30 assumes the unlocking state.

In particular, in the locking state, the distance Δx between the first engagement portion 34 and the second engagement portion 25 may be configured such that the tongue 30 is displaced in the unlocking direction along the displacement axis Ax a distance Dax in response to receiving an elongated element 70 of diameter Di, which may be constant cross-sectional diameter. The distance Δx may be measured along the plane H.

More in particular, the locking groove 60 may be configured such that when the distance between the first engagement portion 34 and the second engagement portion 25 essentially equals the diameter Di of the elongated element 70, the tongue has been caused displace the distance Dax along the displacement axis Ax in response to the unlocking groove 60 receiving of the elongated element 70.

In the locking state, a dimension along the displacement axis Ax between the first engagement portion 34 and an outermost point of the second engagement portion 25 may be greater than Dx.

The displacement groove 40 may be inclined by an angle φ relative the plane of the panels, such as the first panel 1 as shown in FIGS. 4A-4B. Thus, the displacement axis Ax and the plane of the lower surface Px are inclined in respect of the plane H, such as a horizontal plane. An upper surface 55 of the panel 1 and/or a lower surface 56 of the panel 1 may be parallel the plane H. This entails that as the tongue 30 translates along the displacement axis Ax there may be a certain ratio between downwards movement and sideways movement of the tongue 30. For example, the tongue may be displaced the distance Dax in the displacement direction Ax; the sideways movement, typically horizontal, of the tongue 30 then corresponds to Dax*cosine(φ), and the downwards movement corresponds to the Dax*sine(φ). It follows that Di is preferably equal to or greater than the sum of Δx and Dax*cosine(φ), optionally greater by a margin corresponding to the dimension of the play dH. In a non-limiting example, φ may be between 5° and 45°, such as between 10° and 30°, such as about 10°, 20° or 30°.

In the locking state, the first portion 31 of the tongue 30 may be configured to protrude from the displacement groove 40 and/or from the first edge 11 a distance along a direction in the H plane equal to or less than the cross-sectional width Di of the elongated element 70.

In the locking state, the first portion 31 of the tongue 30, such as the outermost point 31*a*, may be configured to protrude from the displacement groove 40 and/or from the first edge 11 a distance along a direction in the H plane equal to or less than the distance between a lower surface 43 of the displacement groove 40 and the first portion 31 in the direction of the normal Ny.

The unlocking groove 60 may be disposed at least partially between the tongue groove 20 and a lower surface 43 of the displacement groove 40.

The second engagement portion 25 may extend at least at a mid-point between the first portion 31 of the tongue 30 and the plane Px of the lower surface 43 of the displacement groove 40, preferably the second engagement portion 25 extends at least to the plane Px of the lower surface 43.

The extension of the second engagement portion 25 in the normal direction Ny may be greater than the corresponding extension of the first engagement portion 34.

The second engagement portion 25 may extend along or inside the vertical plane V.

The second engagement portion 25 may be stationary during displacement of the tongue 30 along the displacement axis Ax in the unlocking direction.

The unlocking groove 60 may be configured such that insertion of the elongated element 70 therein urges the unlocking groove 60 to expand by means applying force on the first engagement portion 34 in the unlocking direction.

The first portion 31 of the tongue 30 may comprise an outer and upper portion of the tongue 30 facing in a direction towards the upper surface 42 of the displacement groove 40. The second portion 32 of the tongue 30 may comprise an outer and preferably lower portion of the tongue 30 facing in a direction towards the lower surface 43 of displacement groove 40.

Figure 5A:
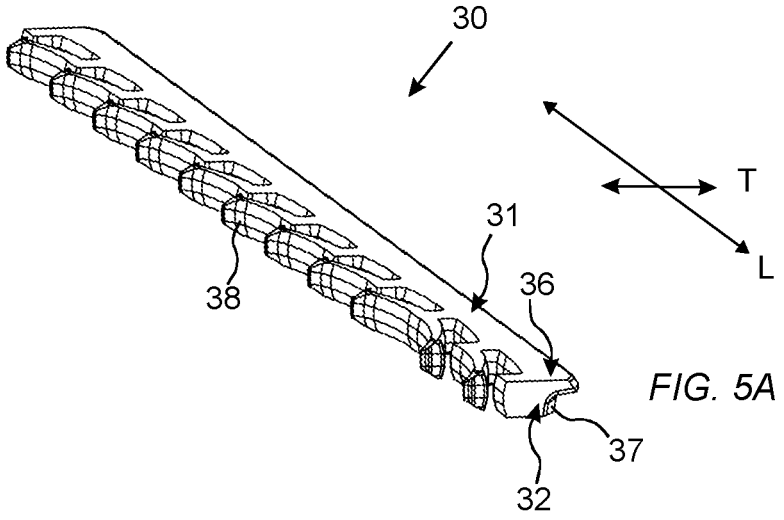
FIG. 5A shows a perspective view of a displaceable tongue according to an embodiment of the inventive concept.

The elongated element 70 may have a longitudinal length corresponding to at least the length of the first 11 and/or second edge 22, such as a respective short edge of the first 1 and/or second panel 2. Alternatively, the elongated element 70 may have a longitudinal length corresponding to at least the length of the tongue 30 in the longitudinal direction L thereof, as indicated in FIG. 5A.

The locking groove 60 may form a needle bearing with the elongated element 70 in the unlocking state and may thus act as a needle bearing during disassembling of the panels in a direction opposite the engagement direction, typically vertical and upwards movement of the second panel 2 as shown in FIGS. 2A-B.

The diameter of the elongated element 70 may be in the range of 0.5 to 3 mm, such as 0.8 to 1.5 mm, preferably about 1.1 mm.

The thickness of the panels 10, 20 may be in the range of about 3 mm to about 10 mm, and preferably in the range of about 4 mm to about 8 mm.

The mechanical locking system comprises a first locking strip 6, at the first or the second edge 11, 22, provided with a first locking element 8 configured to cooperate for horizontal locking with a first locking groove 28 at the other of the first 11 or second edge 22.

Figure 3C:
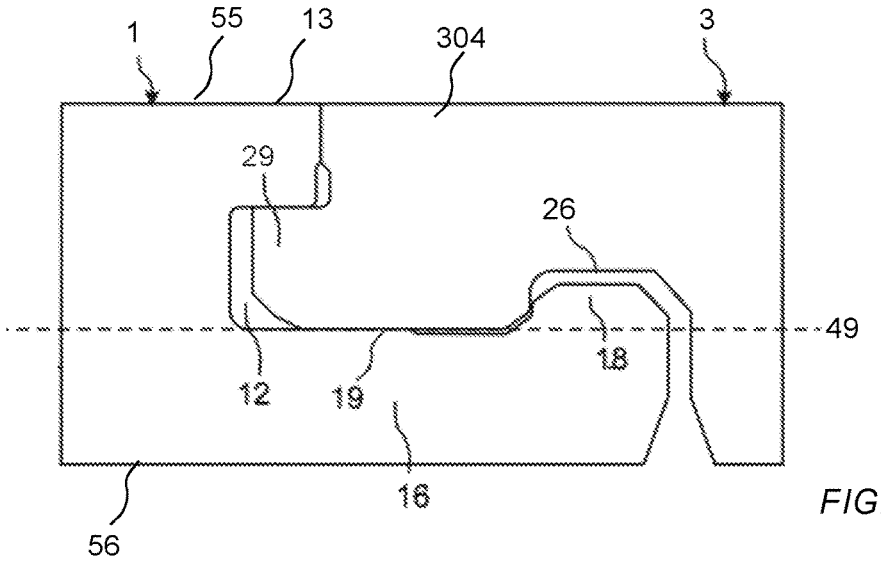
FIG. 3C shows a schematic cross-sectional view of panels according to an embodiment of the inventive concept.

FIG. 3C shows a cross section of a third edge 13 of the first panel 1 and a fourth edge 304 of a third panel 3. The mechanical locking system at the third 13 and the fourth edge 304 comprises a second tongue 29 at the fourth edge 304 configured to cooperate for vertical locking with a second tongue groove 12 at the third edge 13. The third edge 13 is provided with a protruding second locking strip 16 with a second locking element 18 configured to cooperate for horizontal locking with a second locking groove 26 at the fourth edge 304. A second upper surface 19 of the second locking strip 16 is in contact with a lower surface of the second tongue 29 for locking in the vertical direction. The shown mechanical locking system at the third 13 and the fourth edge 304 is configured to be locked by an angling motion. The second upper surface 19 is positioned in a horizontal plane 49. The embodiment in FIG. 3C is exemplary, other mechanical locking systems are conceivable at the third edge 13 and the forth edge 304.

An upper surface 9 of the first locking strip 6 may be provided in a same plane 49 as an upper surface 19 of the second locking strip 16.

The mechanical locking system at the third 13 and the fourth edge 304 may be configured to be assembled by an angling motion, such as a pivoting displacement about the fourth edge 304.

The mechanical locking system at the first 11 and the second edge 22 may be configured to be assembled by a vertical motion.

The mechanical locking system at the first 11 and the second edge 22 may be configured to be assembled by a vertical motion, such as a vertical motion of the second edge 22 of the second panel 2 in the engagement direction E (see FIG. 3A) relative the first panel 1.

The panels may be floorboards comprising a wood fibre-based core, such as HDF, or a core comprising thermoplastic, such as PVC.

Figure 5B:
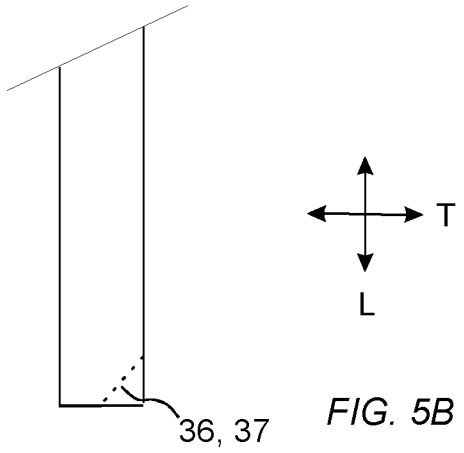
FIG. 5B shows a top view of details of a displaceable tongue of FIG. 5A.

The tongue 30 may comprise a chamfered end portion 36 as illustrated in FIGS. 5A-5B. The end portion 36 may be a longitudinal L end portion. In particular, the second portion 32 of the tongue 30 may comprise a chamfered end portion 36 forming a guiding surface 37 extending in the longitudinal and transverse direction of the tongue 30. The second portion 32 of the tongue 30 may have a longitudinal L edge and a transverse edge as shown in FIG. 5A. A transition between the longitudinal edge and the transverse edge of the second portion 32 and/or a corner of the second portion 32 between the longitudinal edge and the transverse edge of the tongue 30 may comprise the chamfered end portion 36. Thereby forming the guiding surface 37 extending in the longitudinal and transverse direction of the tongue 30.

The guiding surface 37 may be configured to guide the elongated element 70 in the transverse T direction of the tongue 30 as the elongated element 70 is inserted in the unlocking groove 60 in a longitudinal direction of the tongue 30.

As also shown in FIG. 5A, the tongue 30 may comprise biasing means 38 configured to bias the tongue 30 to displace along the displacement axis Ax in the locking direction. The biasing means 38 may be in the form of resilient feathers which may be formed integrally with the tongue 30. The biasing means 38 may be configured to abut at least the bottom surface 41 of the displacement groove 40.

Figure 6:
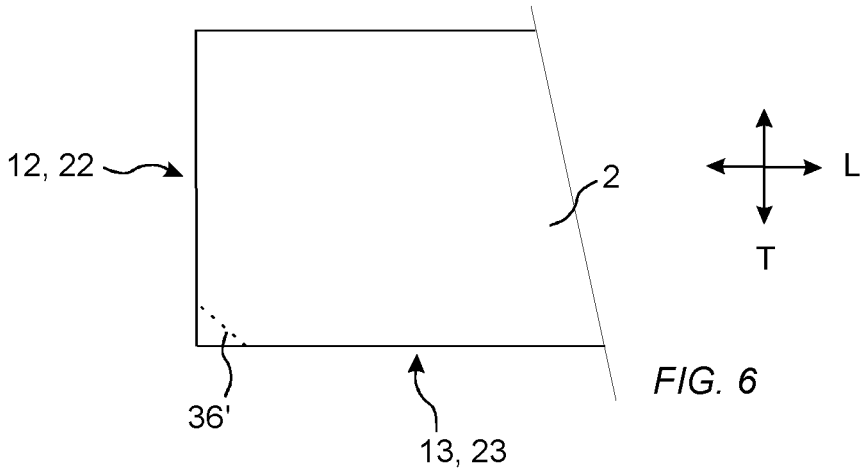
FIG. 6 shows a schematic view of a short edge of a panel according to an embodiment of the inventive concept.

As shown in FIG. 6, the second edge 22 may comprise a chamfered edge portion 36' for guiding the elongated element 70 in the longitudinal L direction of the panel 2 towards the unlocking groove 60.

The panel 1, 2 may have a longitudinal L edge and a transverse edge as shown in FIG. 6. A transition between the second edge 12, 22 and the third edge 13, 23 and/or a corner between the second edge 12, 22 and the third edge 13, 23 may comprise the chamfered end portion 36. Thereby forming the guiding surface 36' extending in the longitudinal L and transverse T direction of the panel 1, 2.

In one embodiment shown in FIGS. 7A-7B and 8A-8C, an embodiment of the inventive concept is configured to be applied in panels intended to be arranged in a herringbone pattern.

Figure 7A:
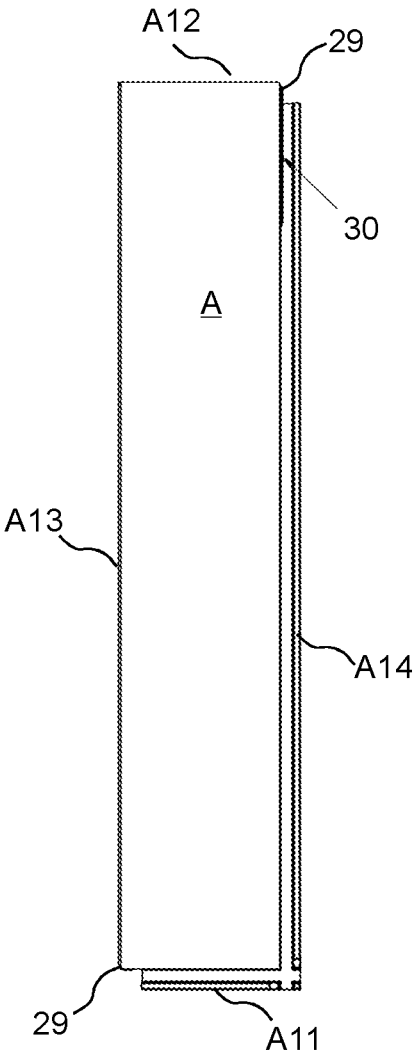
FIG. 7A-7B shows a schematic illustration of further embodiments of the inventive concept.
Figure 7B:
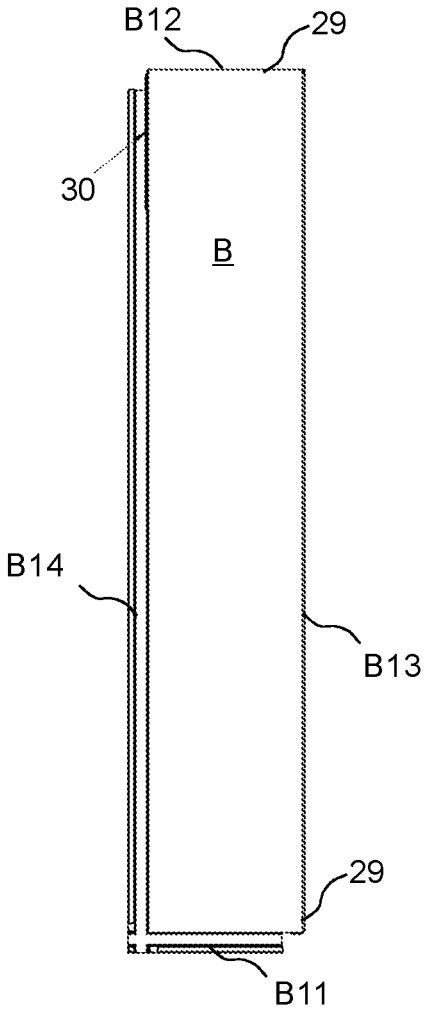

In a non-limiting example, such herringbone pattern may comprise two types of panels. An A-type panel and a B-type panel. The A-type panel and the B-type panel may mirror each other and/or be counter images of each other, as shown in FIG. 7 where FIG. 7A shows an A-type panel and FIG. 7B shows a B-type panel.

The A-type panel and the B-type panel may each comprise a short edge A11, A12, B11, B12 and a long edge A13, A14, B13, B14, wherein a long edge, such as A14, B14 may comprise a shape corresponding to the first edge 11 of the first panel 1 as explained above, for example in relation to FIGS. 3A-3B. A short side edge, such as A12, B12 may be edges corresponding to the second edge 22 as explained in relation to FIGS. 3A-3B. However, only a portion of the long edge, such as long edges A14, B14, comprises the displaceable tongue 30, as illustrated in FIGS. 7A-7B and 8A-8C.

One of the respective short sides of panel A and B, such as A11 and B11 or A12 and B12 may comprise an edge corresponding to the third edge 13 as explained with reference to FIG. 3C and the other edge may correspond to that of the fourth edge 304 as explained with reference to FIG. 3C.

Figure 8A:
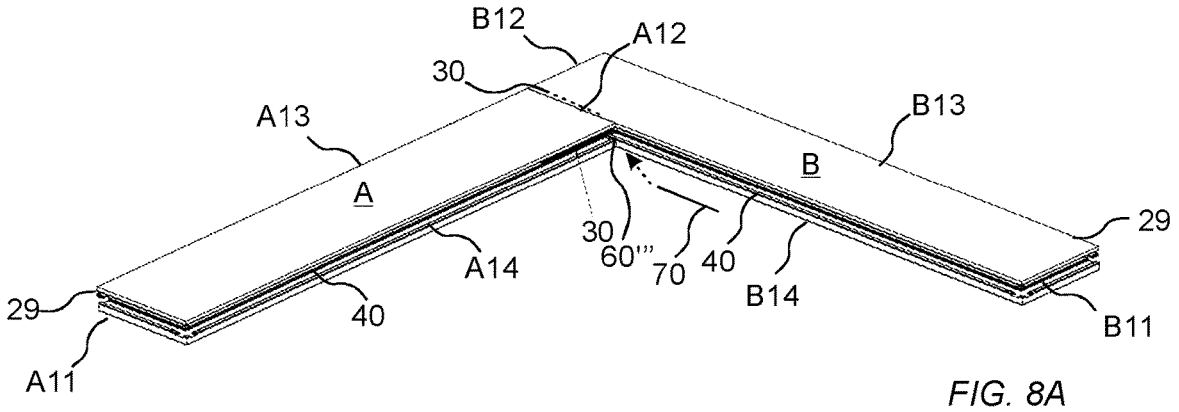
FIGS. 8A-8C show a schematic illustration of the embodiments of FIG. 7.
Figure 8B:
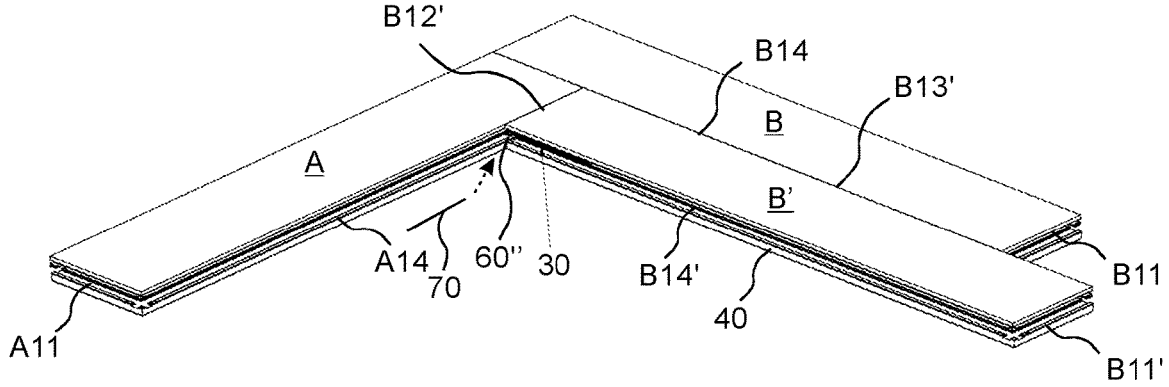
Figure 8C:
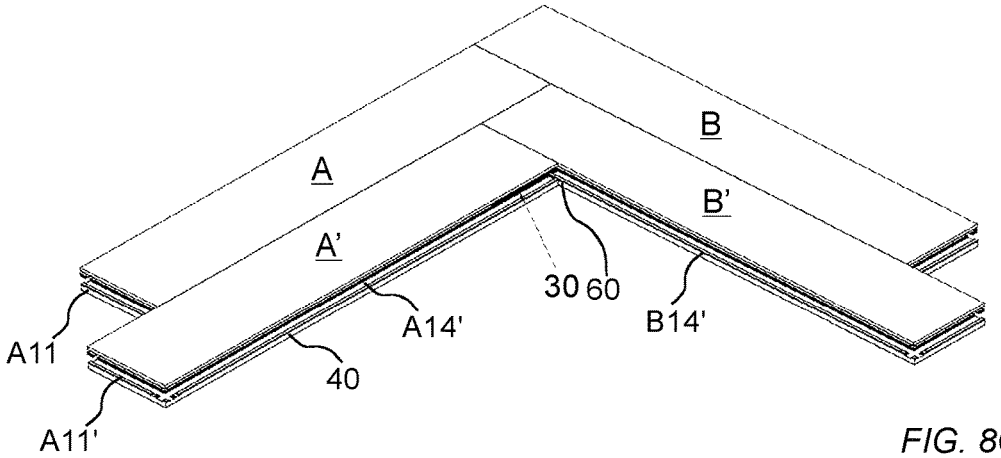

A further long side, such as A13 and/or B13 may comprise a shape corresponding the fourth 304 edge as explained with reference to FIG. 3C such that the tongue 29 of a panel, such as panel A' or B' is received in the displacement groove 40 of the adjacent panel, such as panel A or B, as shown in FIGS. 8B-8C. It follows for example that panel B' may be assembled in locking position with panel A by means of vertical displacement of the second edge B12' i.e. the short side of panel B' relative the fourth edge A14, i.e. the long side of panel A.

It is thereby achieved that the herringbone pattern can be laid in part by means of vertical engagement to form a braid. It is further achieved that panels of the herringbone pattern may be disengaged by rotation and/or vertically instead of lateral sliding. This vastly facilitates ease of both assembling and disassembling of the floating floor.

In a non-limiting example, a herringbone pattern, such as the one shown in FIGS. 8A-8B, may be disassembled by means of a method comprising one or more of: providing the elongated element 70; inserting the elongated element 70 in a first unlocking groove, such as 60", between a second edge, such as B12', of a first panel, such as B', and a fourth edge, such as A14, of an adjacent second panel, such as A, to thereby vertically unlock the second edge of the first panel and the fourth edge of the second panel; pivoting or angling the said first panel to thereby horizontally unlock a third edge, such as B13', of the first panel and a fourth edge, such as B14, of an adjacent third panel, such as B; removing the first panel;

inserting the elongated element 70 in a second unlocking groove, such as 60'", between a second edge, such as A12, of the second panel and a fourth edge, such as B14, of the third panel to thereby vertically unlock the second edge of the second panel and the fourth edge of the third panel; removing the second panel.

Figure 9A:
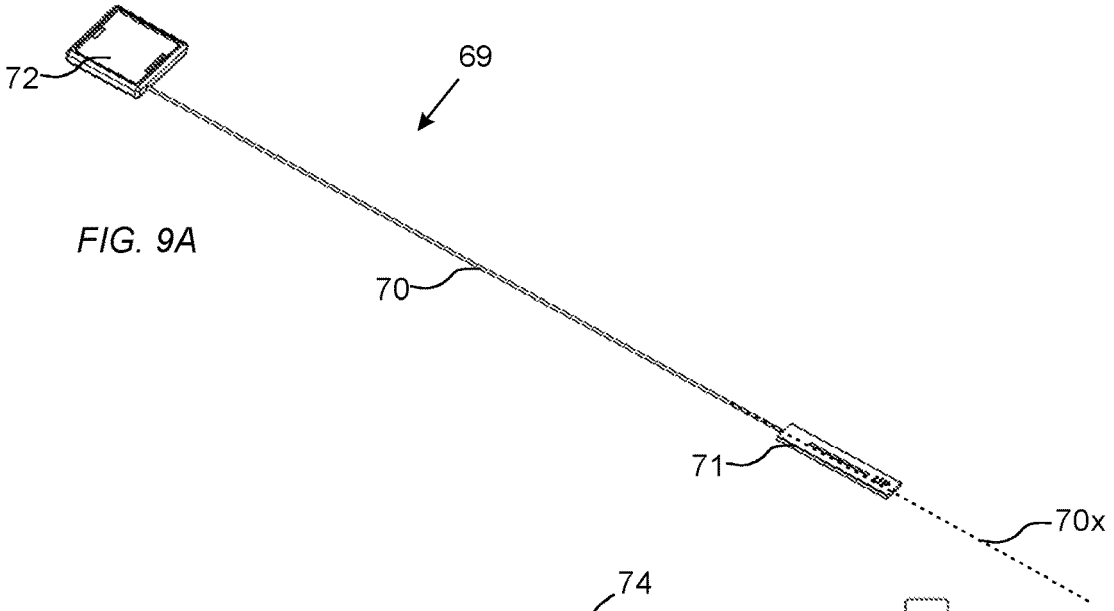
FIG. 9A shows a perspective view of a device for disassembling assembled building panels, according to an embodiment of the inventive concept.

FIG. 9A shows a perspective view of a device 69 for disassembling assembled building panels, such as the building panels shown in FIGS. 8A-8C. The device of FIG. 9A may be particularly suitable for disassembling building panels assembled to form a herringbone pattern, such as by means of the mechanical locking system of the first panel 1 and the second panel 2 as explained in relation to FIGS. 3A, 3B, 4A and 4B FIG. 9B shows a side view of the positioning element 71 according to an embodiment of the inventive concept.

The positioning element 71 may comprise visual indication means 74, such as a text and/or sign indicating an intended orientation of the positioning element in the displacement groove. The visual indication means may facilitate ease of use. The visual indication means may facilitate proper function of the device during use.

Figure 9B:
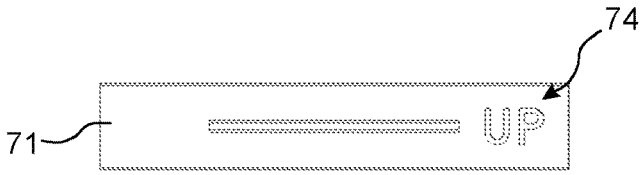
FIG. 9B shows a side view of a positioning element according to an embodiment of the inventive concept.
Figure 9C:
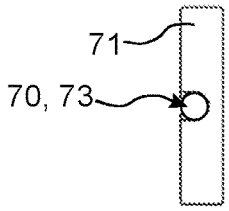
FIG. 9C shows another side view of the embodiment of FIG. 9B.

FIG. 9C shows another side view of the embodiment of FIG. 9B. The positioning element may comprise a through-hole 73, extending from one side to an opposite side of the positioning element, preferably in a longitudinal direction of the positioning element.

Figure 9D:
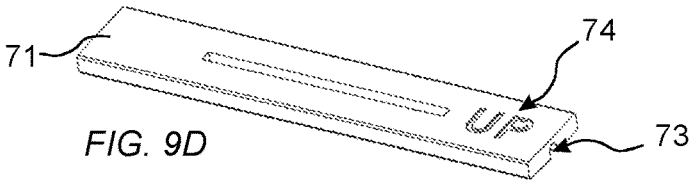
FIG. 9D shows a perspective view of the embodiment of FIG. 9B.

FIG. 9D shows a perspective view of the embodiment of FIG. 9B.

Figure 10:
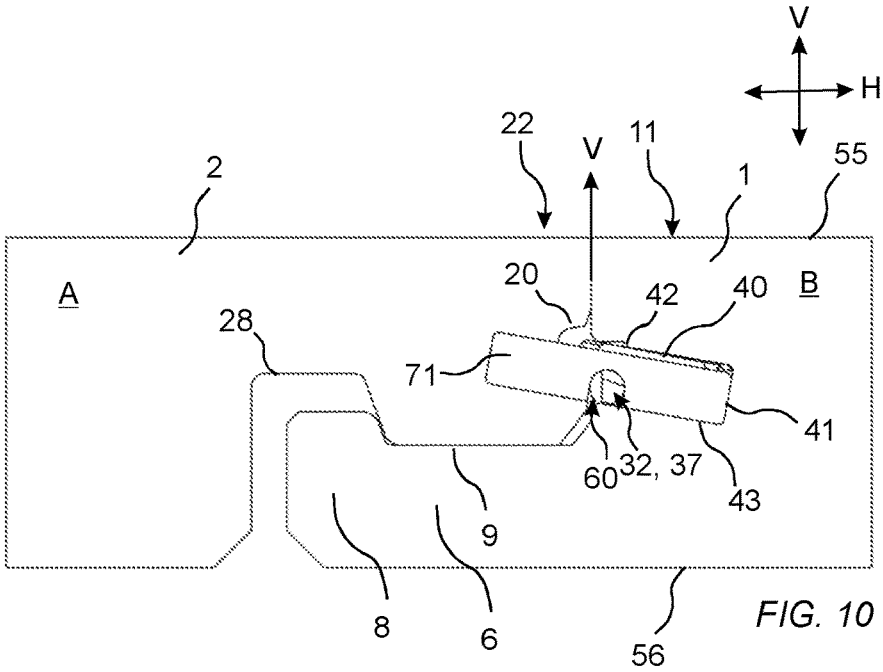
FIG. 10 shows a cross view of a positioning element arranged in a displacement groove of a building panel, according to an embodiment of the inventive concept.

FIG. 10 shows a cross view of a positioning element arranged in a displacement groove of a building panel 1, which may be a Type-A or Type-B panel, according to an embodiment of the inventive concept. For ease or explaining the inventive concept, the elongated element 70 has been omitted in FIG. 10, however, typically the elongated element may be arranged in the through-hole 73 of the positioning element 70. As derivable from FIG. 10, the positioning element may facilitate a centre axis 70*x* of the elongated element is positioned at a predetermined position when the positioning device is arranged in the displacement groove 40. Preferably, when the positioning element is arranged in the displacement groove, an opening of the through-hole may be arranged adjacent an opening of the unlocking groove 60, 60", 60'".

Preferably, when the positioning element is arranged in the displacement groove, an opening of the through-hole may be arranged adjacent the second portion 32 of the locking tongue 30.

Preferably, when the positioning element is arranged in the displacement groove, at least a portion of the through-hole may be aligned with the unlocking groove.

Preferably, when the positioning element is arranged in the displacement groove, at least a portion of an opening of the through-hole may be arranged adjacent the guiding surface 37.

Preferably, when the positioning element is arranged in the displacement groove, at least a portion of the through-hole may be may be aligned with the guiding surface 37.

The positioning element may facilitate a centre axis 70*x* of the elongated element is positioned at a predetermined distance from the bottom surface 41 of the displacement groove, preferably also at a predetermined distance from the lower surface 43 of the displacement groove, optionally also at a predetermined distance from the upper surface 42 of the displacement groove 40, as illustrated in FIG. 10.

Figure 11A:
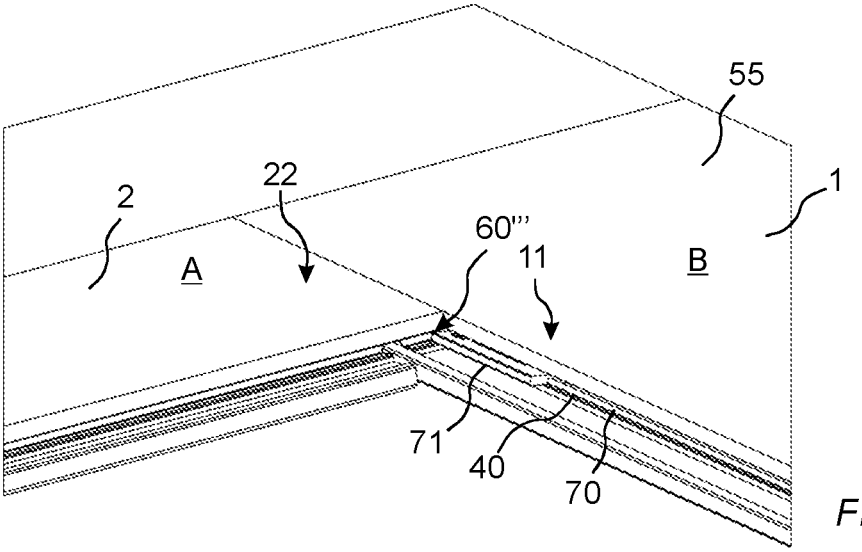
Figure 11B:
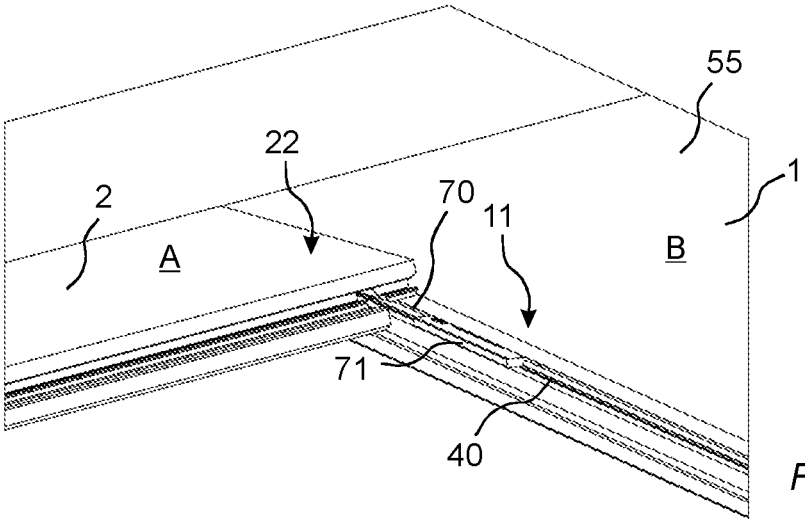
Figure 11C:
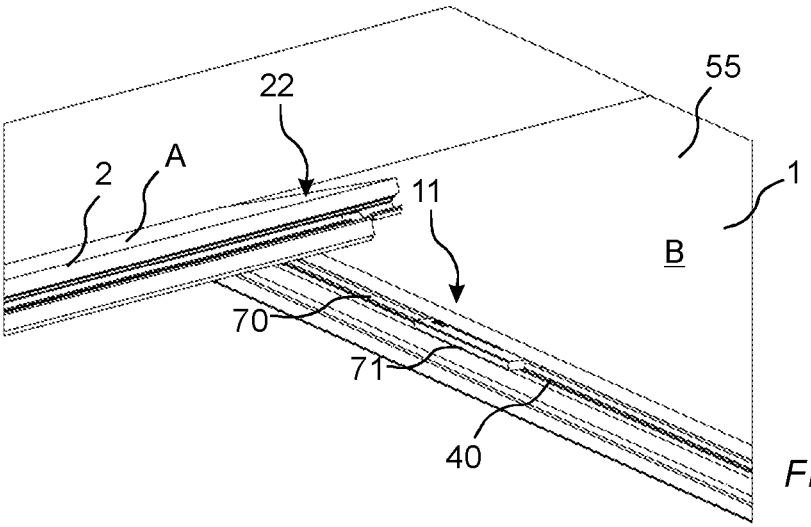

FIGS. 11A-11C schematically illustrate a method of disassembling assembled building panels, according to an embodiment of the inventive concept.

FIG. 11A shows two assembled building panels, such as the panel A, which may correspond to the second panel 2, and having second edge 22. FIG. 11A also shows the device of FIG. 9A arranged in a displacement groove of one of panel B, which may correspond to the first panel 1 and having a first edge 11.

FIG. 11B shows at least a portion of the elongated element 70 of the device 69 of FIG. 9A having been inserted in an unlocking groove 60, 60", 60'" shown in FIG. 11A to thereby displace the locking tongue in the unlocking direction to obtain the unlocking position or state. Consequently, there may be provided horizontal play between the first portion 31 of the locking tongue 30 and the engagement portion 25 of the second edge 22 of the second panel, whereby the second panel 2 may be displaced vertically, hence whereby the second panel 2 is vertically unlocked from the first panel 1.

FIG. 11C shows a first and second building panel being disassembled by means of a vertical displacement of a second edge 22 of the second panel 2 relative a first edge 11 of a first panel 1.

When the word "about" or "essentially" or "substantially" is used in this specification in connection with a numerical value, it is intended that the associated numerical value include a tolerance of +/−10% around the stated numerical value.

ITEMS

ITEM 1. A set of essentially identical panels 1, 2, such as building panels, provided with a mechanical locking system comprising:

a displaceable tongue 30 arranged in a displacement groove 40 having a first opening at a first edge 11 of a first panel 1, said tongue 30 being configured to be displaced in said displacement groove 40 along a displacement axis Ax to attain a locking state wherein a first portion 31 of the tongue 30 cooperates with a first tongue groove 20 having a second opening at a second edge 22 of an adjacent second panel 2, for vertical locking of the first and the second edge 11, 22; and wherein a second portion 32 of said tongue 30 is configured to cooperate with said second edge 22 of said adjacent second panel 2 via an elongated element 70 for vertical unlocking of the first and the second edge 11, 22.

ITEM 2. Set of panels according to item 1, wherein a first engagement portion 34 of the second portion 32 is configured to engage with the elongated element 70 and delimits an unlocking groove 60 configured to receive the elongated element 70 such as to cause the tongue 30 to be displaced along the displacement axis Ax to attain an unlocking state for said vertical unlocking of the first 11 and the second edge 22.

ITEM 3. Set of panels according to item 1 or 2, wherein a second engagement portion 25 of the second edge 22 is configured to engage with the elongated element 70 and delimits the unlocking groove 60, preferably said second engagement portion 25 being provided externally of said first tongue groove 20, more preferably externally of and below said first tongue groove 20.

ITEM 4. Set of panels according to item 2 or 3, wherein said first engagement portion 34 and said second engagement portion 25 are planar and extend in parallel or substantially in parallel, preferably side by side and in parallel.

ITEM 5. Set of panels according to any one of items 2 to 4, wherein said unlocking groove 60 is configured to attain said unlocking state upon receiving an elongated element 70 having a constant cross-sectional width Di in the longitudinal direction of said elongated element 70.

ITEM 6. Set of panels according to any one of the preceding items, wherein said displacement groove 40 comprises a bottom surface 41, an upper surface 42 and a lower surface 43, preferably said lower surface 43 being parallel to the upper surface 42 and/or parallel to the displacement axis Ax of the tongue 30.

ITEM 7. Set of panels according to item 6, wherein the second engagement portion 25 extends below a plane Px of the lower surface 43.

ITEM 8. Set of panels according to item 6 or 7, wherein a dimension Dy in the direction of a normal Ny of a plane Px of said lower surface 43, between the lower surface 43 and the first portion 31, corresponds at least to a maximum diameter Di of the elongated element 70.

ITEM 9. Set of panels according to any one of items 6 to 8, wherein a dimension Dy in the direction of the normal Ny of a plane Px of said lower surface 43, between the lower surface 43 and the first portion 31, corresponds at least to a dimension Dx along the displacement axis Ax between the first engagement portion 34 and an outermost point 31*a* of the tongue 30.

ITEM 10. Set of panels according to any one of items 6 to 8, wherein a dimension Dy in the direction of the normal Ny of a plane Px of said lower surface 43, between the plane Px and the first portion 31 corresponds at least to a largest distance Dax along the displacement axis Ax between the second engagement portion 25 and an outermost point 31*a* of the tongue 30 in the locking state, preferably the largest distance of dimension Dax is measured between an outermost point of the second engagement portion 25 and an outermost point 31*a* of the tongue 30.

ITEM 10a. Set of panels according to any one of the preceding claims 9 to 10, wherein the dimension Dy is measured from a point on a lower surface of the first portion 31, said point being aligned, in the direction of the normal Ny, with an uppermost point of the elongated element 70.

ITEM 11. Set of panels according to any one of the preceding items 3 to 10a, wherein the second portion 32 and the diameter Di of the elongated element 70 are configured to cooperate such that the tongue 30 is displaced along the displacement axis Ax at least to the extent that an outermost point of the second engagement portion 25 and an outermost point 31*a* of the first portion 31 do not overlap, preferably to the extent that there is provided a play dH in a horizontal plane H between the outermost point of the second engagement portion 25 and the outermost point 31*a* of the first portion 31.

ITEM 12. Set of panels according to any one of the preceding items, wherein said second portion 32 comprises a chamfered edge portion 36, said edge portion being an outer end portion in the longitudinal direction of the tongue, the chamfered edge portion 36 forming a guiding surface 37 configured to guide said elongated element 70 in the transverse direction T of said tongue 30, preferably a chamfered longitudinal edge portion 36.

ITEM 13. Set of panels according to any one of the preceding items, wherein said second edge 22 comprises a chamfered edge portion 36' for guiding said elongated element 70 towards said tongue 30.

ITEM 14. Set of panels according to any one of the preceding items, wherein said elongated element 70 has a rotationally symmetric cross-section in a transverse plane thereof, by an angle of less than 120 degrees, preferably less than 90 degrees, more preferably being circular.

ITEM 15. Set of panels according to any one of the preceding items, the elongated element 70 preferably configured to abut the second portion 32 and the second edge 22 simultaneously.

ITEM 16. A method for vertical unlocking a set of essentially identical panels 10, 20, such as building panels, provided with a mechanical locking system comprising:

a displaceable tongue 30 arranged in a displacement groove 40 having a first opening at a first edge 11 of a first panel 10, said tongue 30 configured to be displaced in said displacement groove 40 along a displacement axis Ax to attain a locking state wherein a first portion 31 of the tongue 30 is configured to cooperate with a first tongue groove 20 with a second opening at a second edge 22 of an adjacent second panel 2, for vertical locking of the first and the second edge 11, 22; and wherein the method comprises: inserting an elongated element 70 in an unlocking groove 60 delimited by a first engagement portion 34 of said second portion of said tongue 30 and further delimited by a second engagement portion 25 of the second edge 22 of the second panel 2 disposed externally said tongue groove 20, to thereby cause said tongue 30 to be displaced along the displacement axis Ax to attain an unlocking state for vertical unlocking of the first 11 and the second edge 22.

ITEM 17. The method according to item 16, wherein the second portion 32 and the diameter Di of the elongated element 70 are configured to cooperate such that the tongue 30 is displaced along the displacement axis Ax at least to the extent that an outermost point of the second engagement portion 25 and an outermost point 31*a* of the first portion 31 do not overlap.

ITEM 18. The method according to item 16 or 17, wherein the second portion 32 and the diameter Di of the elongated element 70 are configured to cooperate such that the tongue 30 is displaced along the displacement axis Ax at least to the extent that there is provided horizontal H play between an outermost point of the second engagement portion 25 and an outermost point 31*a* of the first portion 31.

ITEM 19. The method according to any one of items 16 to 18, further comprising:

providing a positioning element 71 to said elongated element 70;

arranging said positioning element in said displacement groove 40.

ITEM 20. A device 69 for unlocking a mechanical locking system of building panels 1, 2, such as a set of building panels, assembled by means of said mechanical locking system, said mechanical locking system configured for horizontal and vertical locking of adjacent building panels, said locking system comprising at a first edge 11 of a first building 1, a displaceable locking tongue 30 configured to displace in a displacement groove 40 provided in said first edge of said first building panel, said locking tongue configured to displace between a locking position and an unlocking position, wherein the locking position, the locking tongue 30 is configured in a protruding position wherein protruding from said displacement groove for cooperating with a tongue groove 20 provided in an adjacent edge 22 of a second adjacent building panel 2;

wherein the unlocking position, the locking tongue is configured in a retracted position, wherein said unlocking device comprises an elongated element 70 and a positioning element 71, wherein said positioning element is configured to be received in said displacement groove.

ITEM 21. Device according to item 20, wherein said positioning element is configured to be received in said displacement groove to thereby position a centre axis 70*x* of said elongated element at a predetermined distance from a bottom surface 41 of the displacement groove.

ITEM 22. Device according to item 20, wherein said positioning element is configured to position a centre axis 70*x* of the elongated element 70 in parallel with said first edge 11, preferably parallel an upper surface 55 of the first panel.

ITEM 23. Device according to any one of items 20 to 22, wherein said positioning element is configured to be received in said displacement groove to thereby position a centre axis of said elongated element at a predetermined distance from a lower surface 43 of the displacement groove.

ITEM 24. Device according to any one of items 20 to 23, wherein the locking position, a first portion 31 of the locking tongue cooperates with the tongue groove 20 provided in the adjacent edge 22 of a second adjacent building panel 2.

ITEM 25. Device according to any one of the preceding items 20 to 24, wherein the unlocking position, the first portion 31 of the locking tongue is configured such that there is provided horizontal H paly between an outermost point 31*a* of the first portion 31 and a lower portion 25, such as vertically below said outer portion of said locking tongue, of the second edge 22 of the second adjacent panel 2.

ITEM 26. Device according to any one of items 20 to 25, wherein said locking tongue comprises a second lower portion configured to cooperate with said elongated element for displacing the locking to said unlocking position.

ITEM 27. Device according to any one of items 20 to 26, wherein said second portion is configured to form an unlocking groove 60, 60", 60'" with an edge portion of said second edge of said second panel, when said first and second panel are configured in assembled position, said edge portion provided below and external said tongue groove.

ITEM 28. Device according to any of the preceding claims 20 to 27, wherein said elongated element is rotational symmetric.

ITEM 29. Device according to any one of the preceding claims 20 to 28, wherein said centre axis of said elongated element is positioned at least partially below said tongue groove/below said outer portion of said locking tongue.

ITEM 30. Device according to any one of the preceding items 20 to 29, wherein said device comprises a handle 72.

ITEM 31. Device according to any one of the preceding items 20 to 30, wherein said positioning element is arranged on the elongated element, and preferably configured to be displaced along the elongated element.

ITEM 32. A device 69 for unlocking a mechanical locking system of building panels 1, 2 assembled by means of said mechanical locking system, said mechanical locking system being configured for horizontal and vertical locking of adjacent building panels, said locking system comprising at a first edge 11 of a first building 1, a displaceable locking tongue 30 configured to displace in a displacement groove 40 provided in said first edge of said first building panel, said locking tongue configured to displace between a locking position and an unlocking position, wherein the locking position, the locking tongue 30 is configured in a protruding position wherein protruding from said displacement groove for cooperating with a tongue groove 20 provided in an adjacent edge 22 of a second adjacent building panel 2;

wherein the unlocking position, the locking tongue is configured in a retracted position;

wherein said unlocking device comprises an elongated element 70 and a positioning element 71, wherein said positioning element is configured to be received in said displacement groove to thereby align a centre axis 70*x* of said elongated element with an unlocking groove 60, 60", 60'" configured to receive said elongated element for configuring said locking tongue in said unlocking position in response to insertion of said elongated element in said unlocking groove.

ITEM 33. Device according to item 32, wherein said locking tongue comprises a second lower portion 32 configured to cooperate with said elongated element for displacing the locking to said unlocking position, and wherein said second edge portion 25 of said second panel comprises provided below and external said tongue groove, and wherein said unlocking groove 60, 60", 60'" is formed by said second portion 32 of said locking tongue and said edge portion 25 of said second edge 22, when said first and second panel are configured in assembled position.

ITEM 34. Device according to any one of the preceding items 20 to 33, wherein said building panels comprises a set of building panels.

ITEM 35. A kit comprising the building panels according to any one of items 1 to 14 and a device according to any one of claims 20 to 34.

The invention claimed is:

1. A set of essentially identical panels provided with a mechanical locking system comprising:

a displaceable tongue arranged in a displacement groove having a first opening at a first edge of a first panel, said tongue being configured to be displaced in said displacement groove along a displacement axis to attain a locking state wherein a first portion of the tongue cooperates with a first tongue groove having a second opening at a second edge of an adjacent second panel, for vertical locking of the first and the second edge; and wherein a second portion of said tongue is configured to cooperate with said second edge of said adjacent second panel via an elongated element for vertical unlocking of the first and the second edge, wherein said elongated element has a circular cross-section in a transverse plane thereof.

2. The set of panels according to claim 1, wherein a first engagement portion of the second portion is configured to engage with the elongated element and delimits an unlocking groove configured to receive the elongated element such as to cause the tongue to be displaced along the displacement axis to attain an unlocking state for said vertical unlocking of the first and the second edge.

3. The set of panels according to claim 2, wherein said first engagement portion and said second engagement portion are planar and extend side by side or in parallel or substantially in parallel.

4. The set of panels according to claim 2, wherein said unlocking groove is configured to attain said unlocking state upon receiving an elongated element having a constant cross-sectional width in the longitudinal direction of said elongated element.

5. The set of panels according to claim 1, further comprising an unlocking groove arranged between a second engagement portion of the second edge of the second panel and the second portion of the tongue when the first and second panels are vertically locked, wherein the second engagement portion of the second edge is configured to engage with the elongated element and delimits the unlocking groove, said second engagement portion being provided externally of said first tongue groove.

6. The set of panels according to claim 5, wherein the second portion and the elongated element are configured to cooperate such that the tongue is displaced along the displacement axis at least to the extent that an outermost point of the second engagement portion and an outermost point of the first portion do not overlap.

7. The set of panels according to claim 1, wherein said displacement groove comprises a bottom surface, an upper surface and a lower surface, said lower surface being parallel to the upper surface or parallel to the displacement axis of the tongue.

8. The set of panels according to claim 7, wherein the second engagement portion extends below a plane of the lower surface.

9. The set of panels according to claim 7, wherein a dimension in a direction of a normal of a plane of said lower surface, between the lower surface and the first portion, corresponds at least to a maximum diameter of the elongated element.

10. The set of panels according to claim 7, wherein a dimension in a direction of the normal of a plane of said lower surface, between the lower surface and the first portion, corresponds at least to a dimension along the displacement axis between the first engagement portion and an outermost point of the tongue.

11. The set of panels according to claim 10, wherein the dimension is measured from a point on a lower surface of the first portion, said point being aligned, in the direction of the normal, with an uppermost point of the elongated element.

12. The set of panels according to claim 7, wherein a dimension in a direction of the normal of a plane of said lower surface, between the plane and the first portion corresponds at least to a largest distance of a dimension along the displacement axis between the second engagement portion and an outermost point of the tongue in the locking state, the largest distance of dimension is measured between an outermost point of the second engagement portion and an outermost point of the tongue.

13. The set of panels according to claim 1, wherein said second portion comprises a chamfered edge portion, said edge portion being an outer end portion in the longitudinal direction of the tongue, the chamfered edge portion forming a guiding surface configured to guide said elongated element in the transverse direction of said tongue.

14. The set of panels according to claim 1, wherein said second edge comprises a chamfered edge portion for guiding said elongated element towards said tongue.

15. A method for vertical unlocking a set of essentially identical panels, provided with a mechanical locking system comprising:

a displaceable tongue arranged in a displacement groove having a first opening at a first edge of a first panel, said tongue configured to be displaced in said displacement groove along a displacement axis to attain a locking state wherein a first portion of the tongue is configured to cooperate with a first tongue groove with a second opening at a second edge of an adjacent second panel, for vertical locking of the first and the second edge; and wherein the method comprises:

inserting an elongated element in an unlocking groove delimited by a first engagement portion of said second portion of said tongue and further delimited by a second engagement portion of the second edge of the second panel disposed externally said tongue groove, to thereby cause said tongue to be displaced along the displacement axis to attain an unlocking state for vertical unlocking of the first and the second edge, wherein the second portion and a diameter of the elongated element are configured to cooperate such that the tongue is displaced along the displacement axis at least to the extent that an outermost point of the second engagement portion and an outermost point of the first portion do not overlap, the method further comprising:

providing a positioning element to said elongated element;

arranging said positioning element in said displacement groove.

16. A device for unlocking a mechanical locking system of building panels assembled by means of said mechanical locking system, said mechanical locking system configured for horizontal and vertical locking of adjacent building panels, said locking system comprising at a first edge of a first building panel, a displaceable locking tongue configured to displace in a displacement groove provided in said first edge of said first building panel, said locking tongue configured to displace between a locking position and an unlocking position, wherein the locking position, the locking tongue is configured in a protruding position wherein protruding from said displacement groove for cooperating with a tongue groove provided in an adjacent edge of a second adjacent building panel;

wherein the unlocking position, the locking tongue is configured in a retracted position;

wherein said unlocking device comprises an elongated element and a positioning element, and wherein said positioning element is configured to be received in said displacement groove, wherein said positioning element is configured to be received in said displacement groove to thereby position a centre axis of said elongated element at a predetermined distance from a bottom surface of the displacement groove, wherein said elongated element has a circular cross-section in a transverse plane thereof.

17. A set of essentially identical panels, provided with a mechanical locking system comprising:

a displaceable tongue arranged in a displacement groove having a first opening at a first edge of a first panel, said tongue being configured to be displaced in said displacement groove along a displacement axis to attain a locking state wherein a first portion of the tongue cooperates with a first tongue groove having a second opening at a second edge of an adjacent second panel, for vertical locking of the first and the second edge; and wherein a second portion of said tongue is configured to cooperate with said second edge of said adjacent second panel via an elongated element for vertical unlocking of the first and the second edge, wherein an unlocking groove is arranged between a second engagement portion of the second edge of the second panel and the second portion of the tongue when the first and second panels are vertically locked, wherein the second engagement portion of the second edge is configured to engage with the elongated element and delimits the unlocking groove, said second engagement portion being provided externally of said first tongue groove, wherein the second engagement portion of the second edge is configured to engage with the elongated element and delimits the unlocking groove, said second engagement portion being provided externally of said first tongue groove, wherein said second engagement portion of the second edge being provided externally of and below said first tongue groove.

* * * * *